US008267057B2

(12) United States Patent
Schwitters

(10) Patent No.: US 8,267,057 B2
(45) Date of Patent: Sep. 18, 2012

(54) CONTINUOUSLY VARIABLE VALVE LIFT FOR INTERNAL COMBUSTION ENGINE

(75) Inventor: Stephen W. Schwitters, Rockford, IL (US)

(73) Assignee: Advanced Racing Systems, Inc., Rockford, IL (US)

( * ) Notice: Subject to any disclaimer, the term of this patent is extended or adjusted under 35 U.S.C. 154(b) by 789 days.

(21) Appl. No.: 12/192,598

(22) Filed: Aug. 15, 2008

(65) Prior Publication Data

US 2009/0044774 A1 Feb. 19, 2009

Related U.S. Application Data

(60) Provisional application No. 60/956,120, filed on Aug. 15, 2007.

(51) Int. Cl.
*F01L 1/34* (2006.01)

(52) U.S. Cl. ..... 123/90.16; 123/90.12; 123/90.39; 123/90.45; 74/559; 74/569

(58) Field of Classification Search ..... 123/90.39, 123/90.44, 90.12, 90.13, 90.16, 90.45; 74/559, 74/567, 569

See application file for complete search history.

(56) References Cited

U.S. PATENT DOCUMENTS 6,422,186 B1 * 7/2002 Vanderpoel ..... 123/90.15

* cited by examiner

*Primary Examiner* — Ching Chang
(74) *Attorney, Agent, or Firm* — Rathe Lindenbaum LLP

(57) ABSTRACT

An internal combustion engine includes a camshaft, a valve, a cam follower and a rocker arm. The cam follower is coupled between the camshaft and the valve. The rocker arm is coupled between the cam follower and the valve. At least one of the cam follower and the rocker arm is configured so as to move through an adjustable distance prior to transmitting motion for moving the valve.

37 Claims, 23 Drawing Sheets

CONTINUOUSLY VARIABLE VALVE LIFT FOR INTERNAL COMBUSTION ENGINE

CROSS-REFERENCE TO RELATED PATENT APPLICATIONS

The present application claims priority under 35 USC 119(e) from U.S. Provisional Patent Application Ser. No. 60/956,120 filed on Aug. 15, 2007 by Stephen W. Schwitters and entitled CONTINUOUSLY VARIABLE VALVE LIFT FOR INTERNAL COMBUSTION ENGINE, the full disclosure of which is hereby incorporated by reference.

BACKGROUND

Many vehicles, machines and appliances use engines that regulate the intake and exhaustion of gases to the engine with one or more valves. There is a continuing need to enhance efficiency of such engines and to reduce their emissions.

DETAILED DESCRIPTION OF THE EXAMPLE EMBODIMENTS

Figure 1:
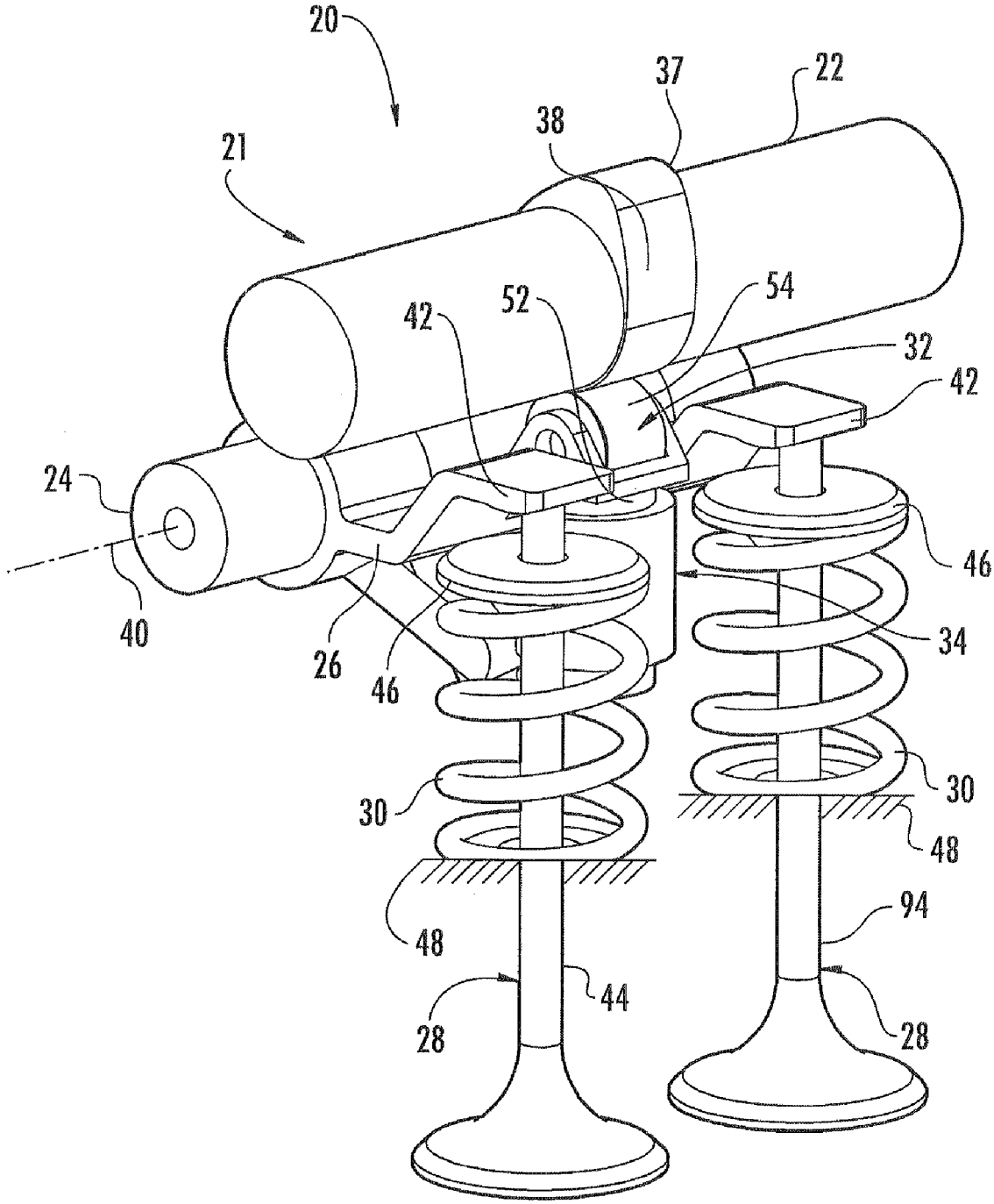
FIG. 1 is a fragmentary perspective view of an engine valve opening and closing control system according to an example embodiment.
Figure 2:
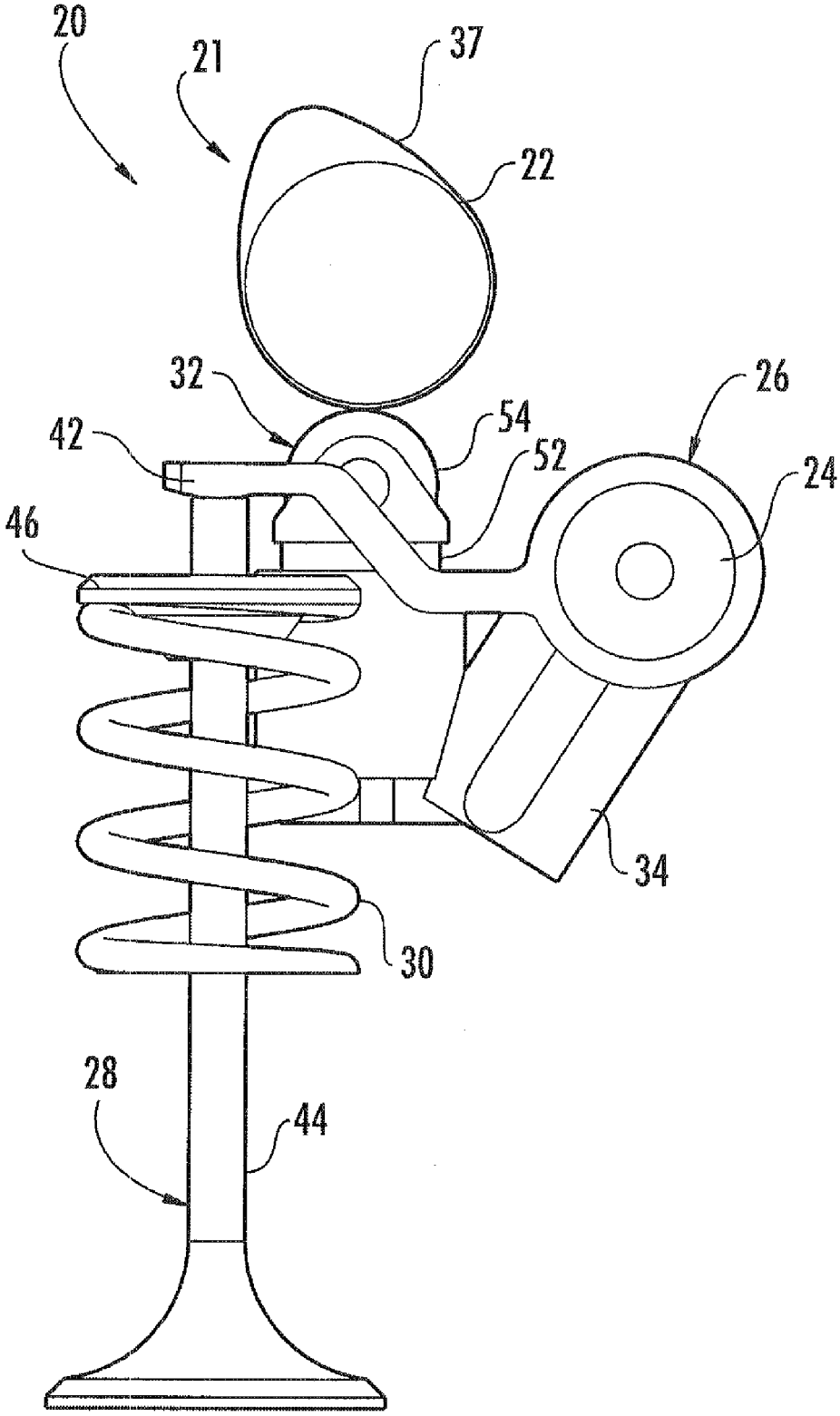
FIG. 2 is a side elevational of the system of FIG. 1.
Figure 3:
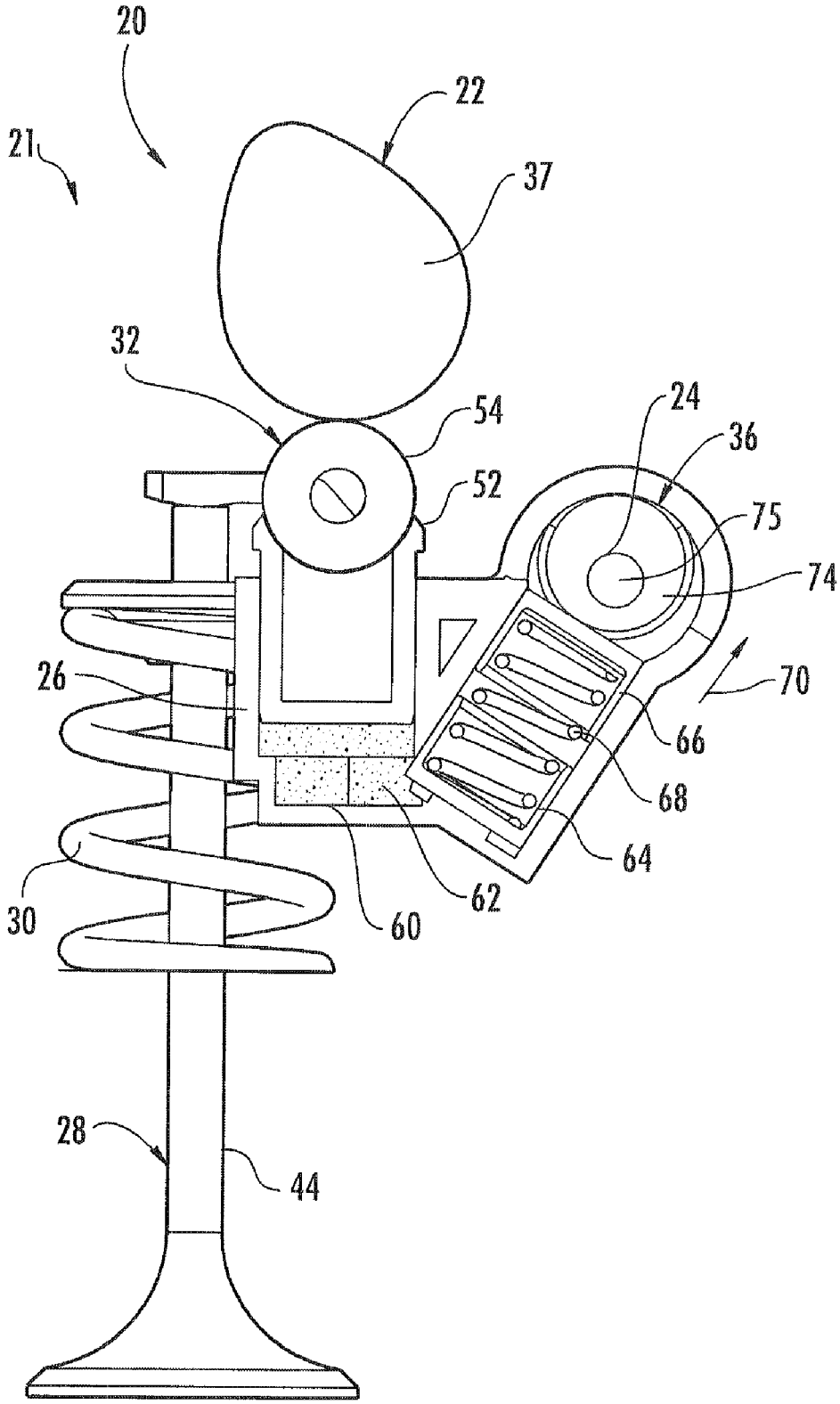
FIG. 3 is a sectional view of the system of FIG. 1.

FIGS. 1-3 illustrate a portion of an internal combustion engine 20 according to an example embodiment. FIGS. 1-3 illustrate a valve opening and closing control system 21 (valve control system 21) of engine 20. FIG. 1 is a fragmentary perspective view of system 21. FIG. 2 is a side elevational view of system 21. FIG. 3 is a sectional view thereof. Engine 20 includes camshaft 22, rocker arm shaft 24, rocker arm 26, valves 28, springs 30, cam follower 32, lost motion mechanism 34 and lost motion adjuster 36. As will be described hereafter, lost motion mechanism 34 and lost motion adjuster 36 facilitate continuously variable adjustment of the lift or movement of valves 28 by camshaft 22 and cam follower 32 for enhanced engine performance and efficiency.

Camshaft 22 comprises a shaft coupled to or rotating in relationship to a crankshaft (not shown) or other timing mechanism. For purposes of this disclosure, the term "coupled" shall mean the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate member being attached to one another. Such joining may be permanent in nature or alternatively may be removable or releasable in nature. The term "operably coupled" shall mean that two members are directly or indirectly joined such that motion may be transmitted from one member to the other member directly or via intermediate members.

As shown by FIG. 1, camshaft 22 includes a lobe or cam 37 having a cam surface 38 which bears against cam follower 32. Rotation of camshaft 22 causes cam 37 to exert a force upon cam follower 32 to move cam follower 32 by varying distances based upon the profile of cam surface 38. Although shown as an eccentrically projecting lobe, cam 37 may have other configurations.

Rocker arm shaft 24 comprises an elongate shaft extending along an axis 40 about which rocker arm 24 rotator pivots. In one embodiment, axis 40, provided by shaft 24, is fixed or stationary. In another embodiment, axis 40 may be movable. Shaft 24 supports rocker arm 26 adjacent to valves 28.

Rocker arm 26 comprises one or more structures configured to pivot about axis 40 so as to move valves 28. Rocker arm 26 is operably coupled to cam follower 32 by lost motion mechanism 34 such that after lost motion provided by lost motion mechanism 34 has been consumed, further motion or movement of cam follower 32 results in rocker arm 26 pivoting about axis 40 to move valves 28. In the example illustrated, rocker arm 26 includes a pair of fingers or extensions 42 in engagement with a pair of valves 28. In other embodiments, rocker arm 26 may include a single extension 42 or greater than two such extensions 42. In other embodiments, rocker arm 26 may have configurations other than that shown.

Valves 28 comprise intake or exhaust valves of internal combustion engine 20. Valves 28 includes stems 44 and heads 46 which are resiliently biased in an upward direction (as seen in FIG. 1) towards extensions 42 by springs 30. Springs 30 are captured between stationary surfaces 48 (schematically shown) and heads 46. Springs 30 resiliently bias valves 28 toward closed states with respect to valve seats (not shown). Depressment of valves 28 by extensions 42 of rocker arm 26 compresses springs 30 and moves valves 28 to an opened state.

Cam follower 32 comprises a structure configured to move in response to rotation of camshaft 22. Cam follower 32 is further configured to move relative to rocker arm 26, as the established dwell or lost motion provided by lost motion mechanism 34 is consumed, and to transmit motion to rocker arm 26 such that rocker arm 26 moves with cam follower 32 after the lost motion or dwell has been consumed. Cam follower 32 is operably coupled between cam 37 of cam shaft 22 and rocker arm 26. Cam follower 32 is operably coupled to rocker arm 26 by lost motion mechanism 34.

In the particular example illustrated, cam follower 32 comprises a plunger 52 (shown in FIG. 3) and a roller 54. Plunger 52 comprises a structure at least partially received within rocker arm 26 and slidable or movable with respect to rocker arm 26. Plunger 52 carries roller 54.

Roller 54 comprises a wheel or roller rotationally supported by plunger 32 opposite to an engagement with cam 37 of camshaft 22. Roller 54 rotates in response to rotation of camshaft 22 and exerts a linear force linear translation to plunger 52 to move plunger 52. In other embodiments, cam follower 32 may have other configurations.

Lost motion mechanism 34 comprises one or more components or structures operably coupled between cam follower 32 and rocker arm 26 configured to provide lost motion or dwell such that prior to consumption of the lost motion or dwell, cam follower 32 moves relative to rocker arm 26 upon rotation of cam shaft 22 and cam 37 without substantial movement of rocker arm 26. After the lost motion or dwell has been consumed, movement of cam follower 32 results in movement of rocker arm 26 to actuate valves 28. As shown by FIG. 3, in the example illustrated, lost motion mechanism 34 includes fluid passage or chamber 60, hydraulic fluid 62, slave cylinder 64, slave cylinder stop 66 and spring 68. Fluid chamber 60 comprises a cavity within rocker arm 26 adjacent to plunger 52 of cam follower 32 which is also received within rocker arm 26. Fluid chamber 60 receives and contains hydraulic fluid 62. Although illustrated as having the illustrated configuration, fluid chamber 60 may have a variety of shapes, sizing configurations.

Hydraulic fluid 62 comprise a fluid coupled between plunger 52 and rocker arm 26. Upon consumption of the dwell, hydraulic fluid 62 transmits force from plunger 52 of cam follower 32 to rocker arm 26 to move rocker arm 26 against valves 28.

Slave cylinder 64, stop 66 and spring 68 cooperate to provide dwell or lost motion. Slave cylinder 64 comprises a structure movably contained within and adjacent to chamber 60. Stop 66 comprises a surface configured to limit an extent to which slave cylinder 64 may move. Spring 68 is captured between stop 66 and cylinder 64 to spring load cylinder 64 and resiliently bias cylinder 64. As plunger 52 of cam follower 32 moves downward (as seen in FIG. 3), hydraulic fluid 62 applies hydraulic force or pressure to slave cylinder 64 to move slave cylinder 64 against the bias of spring 68 in an upward direction as indicated by arrow 70, compressing spring 68. Such movement of slave cylinder 64 continues until spring 68 may no longer be compressed or until cylinder 64 abuts or engages stop 66. During this time, plunger 52 of cam follower 32 moves relative to rocker arm 26, displacing hydraulic fluid 62. Once slave cylinder 64 is no longer movable, the dwell being consumed, further movement of plunger 52 results in movement of rocker arm 26.

Lost motion adjuster 36 comprises a mechanism or arrangement of components configured to selectively adjust an extent of lost motion or dwell provided by lost motion mechanism 34. In the example illustrated, lost motion adjuster 36 comprises a mechanism configured to adjust an extent to which slave cylinder 64 may move prior to spring 68 becoming no longer compressible or prior to cylinder 64 engaging stop 66. In particular, adjuster 36 comprises a mechanism configured to move stop 66 relative to cylinder 64.

In the particular example illustrated, lost motion adjuster 36 comprises an eccentric 74 configured to be rotated about axis 75 (shown in FIG. 3) so as to move stop 66 towards or away from cylinder 64. In the example illustrated, eccentric 74 is mounted to rocker arm shaft 24, wherein rotation of eccentric 74 adjusts the positioning of stop 66 to also adjust an extent to which slave cylinder 64 may move. Rocker arm shaft 24 is configured to be manually rotated about axis 75 by an actuator (not shown) such as an electric motor, a hydraulic piston-cylinder assembly, a pneumatic cylinder-piston assembly, an electric solenoid or other powered rotation device under control of engine control unit 110 (shown in FIG. 4). By adjusting an extent to which slave cylinder 64 may move, eccentric 74 also adjusts the amount of lost motion or dwell provided by slave cylinder 64.

In other embodiments, eccentric 74 may be rotated and supported by other structures other than rocker arm shaft 24. In still other embodiments, other mechanisms may be used to selectively move stop 66 relative to cylinder 64. In yet other embodiments, lost motion adjuster 36 may have other configurations. For example, in other embodiment, the degree or extent of lost motion may alternatively be adjusted by controlling the amount of hydraulic fluid 62 within chamber 60. In such an alternative embodiment, stop 66 may be stationary or fixed, wherein hydraulic fluid is added to or removed from the existing hydraulic fluid 62 within chambers 60 via a hydraulic port associated with chamber 60.

Figure 4:
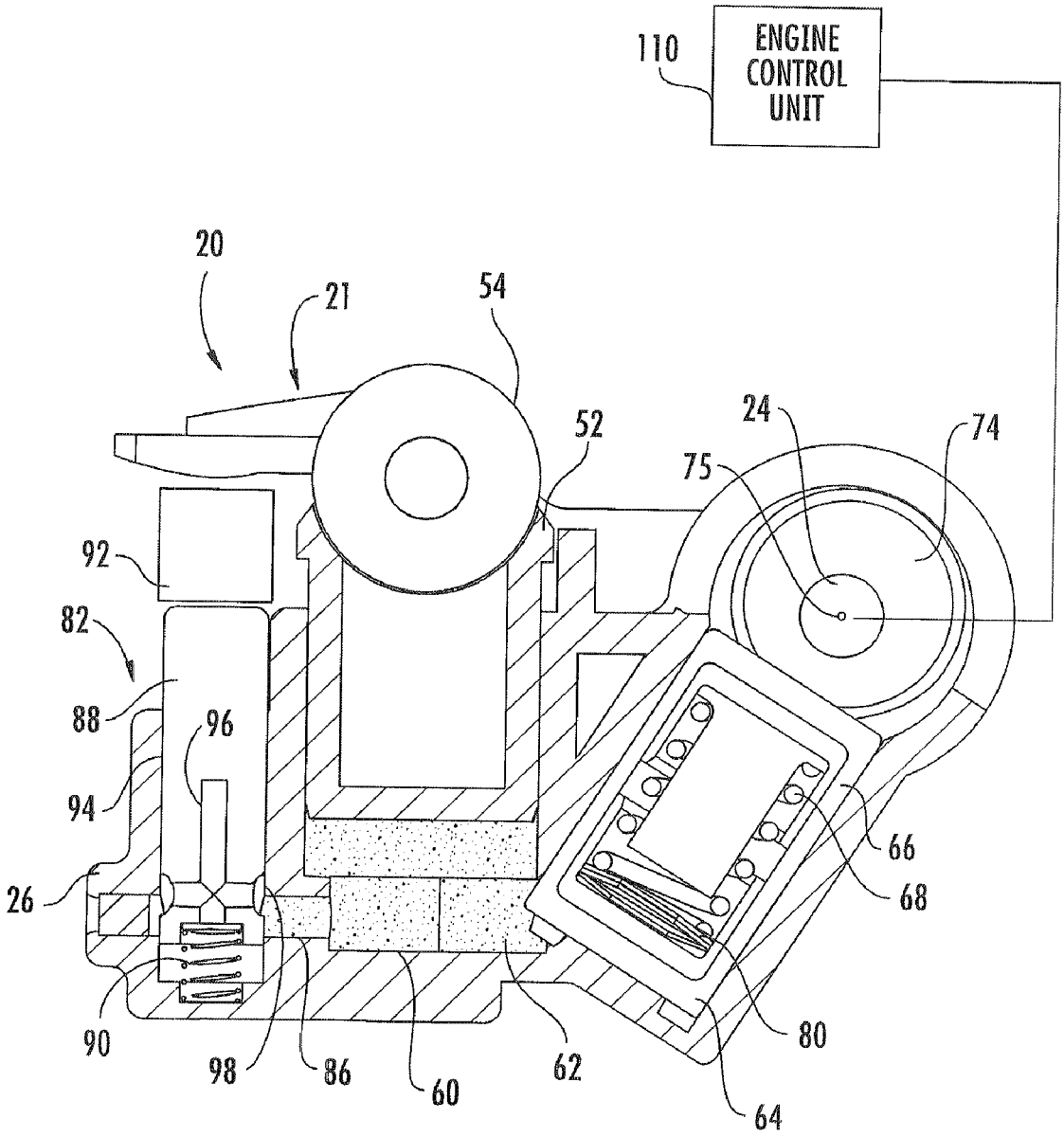
FIG. 4 is a sectional view of another embodiment of the system of FIG. 1.
Figure 5:
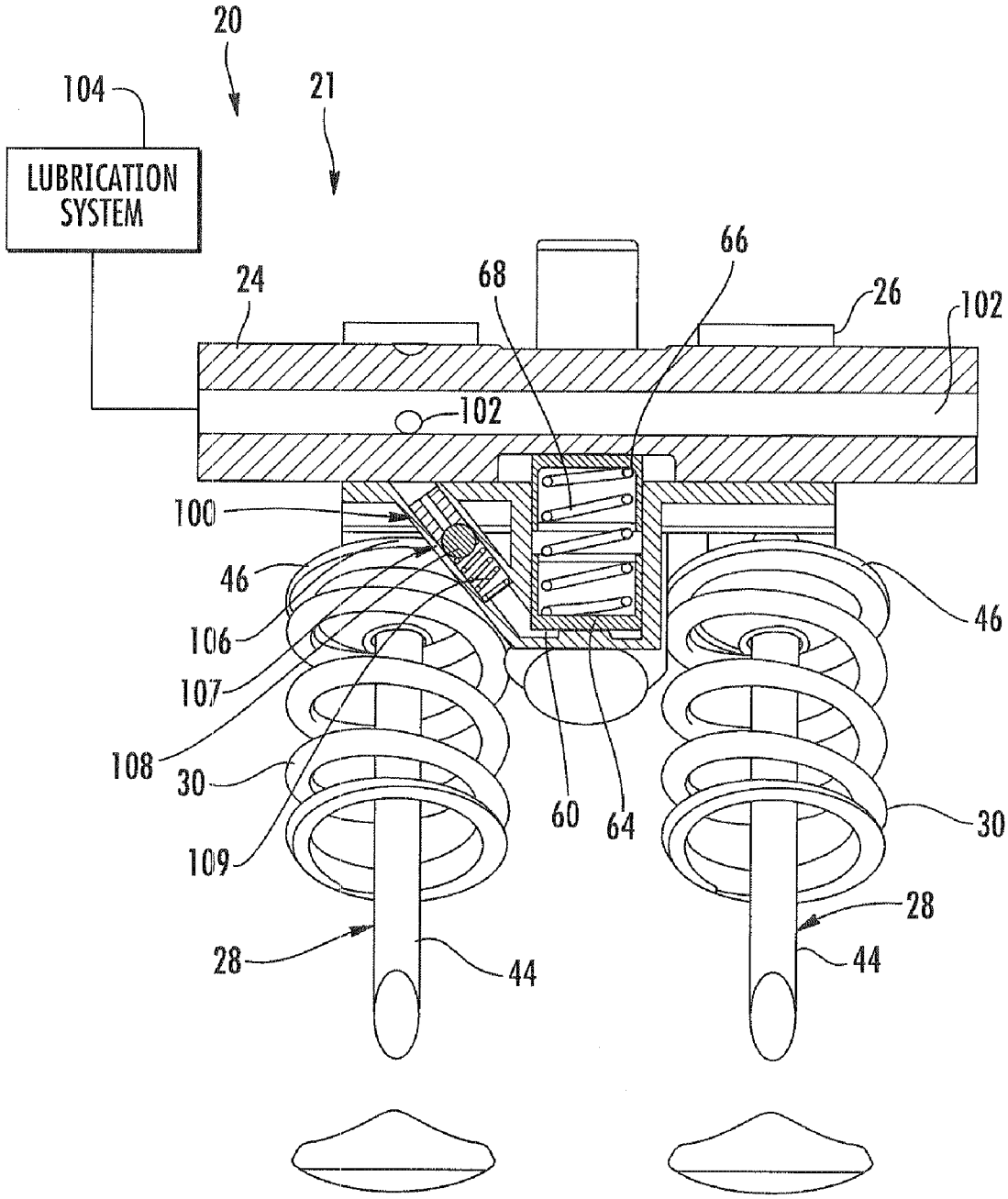
FIG. 5 is a sectional view of another embodiment of the system of FIG. 1.

FIGS. 4 and 5 illustrate portions of engine 20 including additional optional features associated with lost motion mechanism 34. As shown by FIG. 4, lost motion mechanism 34 may additionally include damping systems 80 and 82. Damping system 80 comprises a spring captured between cylinder 64 and springs 80. Damping system 80 provides damping to reduce noise and high stress on valve system components. Damping system 80 further provides smoother acceleration of rocker arm 26 during initial stages of the opening of valves 28 (when the dwell or lost motion has been consumed and when rocker arm 26 is initially driving valves 28 against the bias of springs 30). In the particular example illustrated, damping system 80 comprises a pair of Belleville springs. In other embodiments, damping system 80 may comprise one or more other springs at the location illustrated or at other locations.

Damping system 82 reduces a closure rate of valves 28 during the final closing distance to reduce pounding forces of valves 28 against their associated valve seats (not shown). Damping system 82 includes side passage 86, damping piston or plunger 88, spring 90 and stop 92. Side passage 86 extends from chamber 60 and provides fluid communication between chamber 60 and plunger 88.

Plunger 88 is slidable or movable within a recess or bore 94 provided in rocker arm 26. Plunger 88 includes an internal bore 96 configured to receive hydraulic fluid from chamber 60. Spring 90 resiliently biases plunger 88 against a fixed, adjustable or stationery stop 92. As shown in FIG. 4, bore 96 communicates with chamber 60 via side passage 86 when spring 90 has biased plunger 88 against stop 92. Plunger 88, spring 90 and stop 92 are configured such that as the lost motion is being consumed by downward movement of plunger 52, hydraulic fluid enters bore 96 until the hydraulic pressure is sufficient to overcome the bias of spring 90 so as to lower opening 98 of bore 96 below and out of communication with side passage 86. Further movement of plunger 52 results in the dwell being consumed and the valves being opened. During further rotation of camshaft 22 (shown in FIG. 1), plunger 52 and cam follower 32 will begin to retract from chamber 60 (move in an upward direction as seen in FIG. 4). As this happens, rocker arm 26 moves or pivots in an opposite direction away from valve 28, allowing springs 30 (shown in FIG. 1) to begin to move valves 28 to the closed state. Plunger 88, spring 90 and stop 92 are further configured such that just prior to closing of valve 28 against their seats (not shown), spring 90 moves plunger 88 to position bore 96 in fluid communication with side passage 86 and chamber 60, permitting fluid within the bore 96 to bleed into chamber 60, reducing a closure rate of valve 28. In other embodiments, damping systems 80 and/or 82 may be omitted.

As shown by FIG. 5, engine 20 may additionally include fluid supply system 100. Fluid supply system 100 comprises an arrangement of fluid passages configured to control the amount of hydraulic fluid 62 (shown in FIG. 3) within chamber 60. As shown in FIG. 5, in one embodiment, system 100 comprises an internal bore or passageway 102 formed within rocker arm shaft 24 and hydraulically or fluidly coupled or connected to lubrication system 104. System 100 further includes a fluid conduit 106 extending from passage 102 to chamber 60. To prevent return of hydraulic fluid from cavity 60, system 110 additional includes a check valve 107 comprising a ball 108 and a spring 109 within conduit 106. Fluid supply system 100 permits a full supply of hydraulic fluid to be automatically maintained in chamber 60 for reliable operation. As noted above, in other alternative embodiments, system 100 may be used to control the supply of fluid to adjust the degree or extent of lost motion or dwell provided by lost motion mechanism 34. In other embodiments, system 100 may be omitted.

Figure 6A:
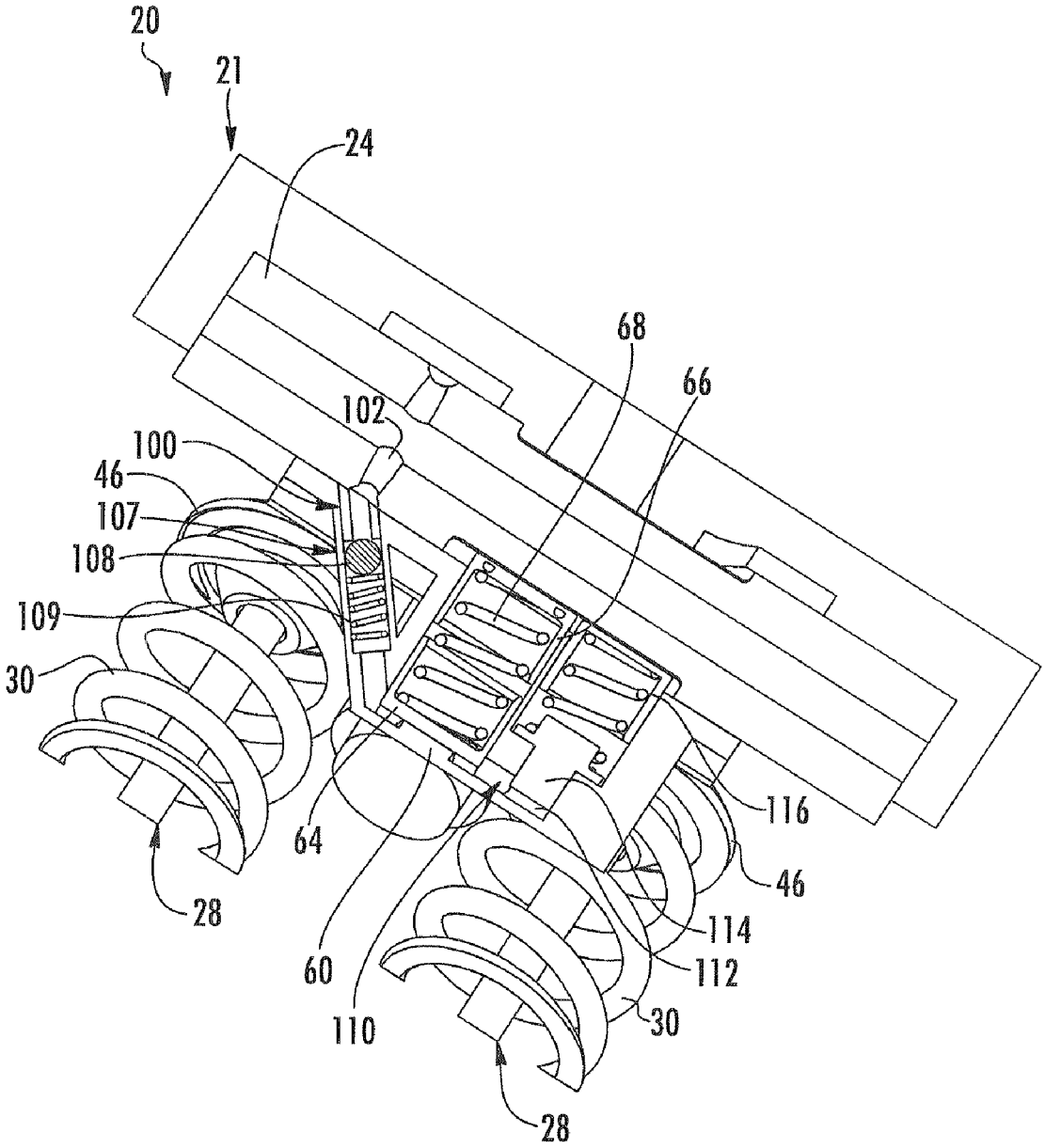
FIG. 6A is a sectional view of another embodiment of the system of FIG. 5 in a first default state.
Figure 6B:
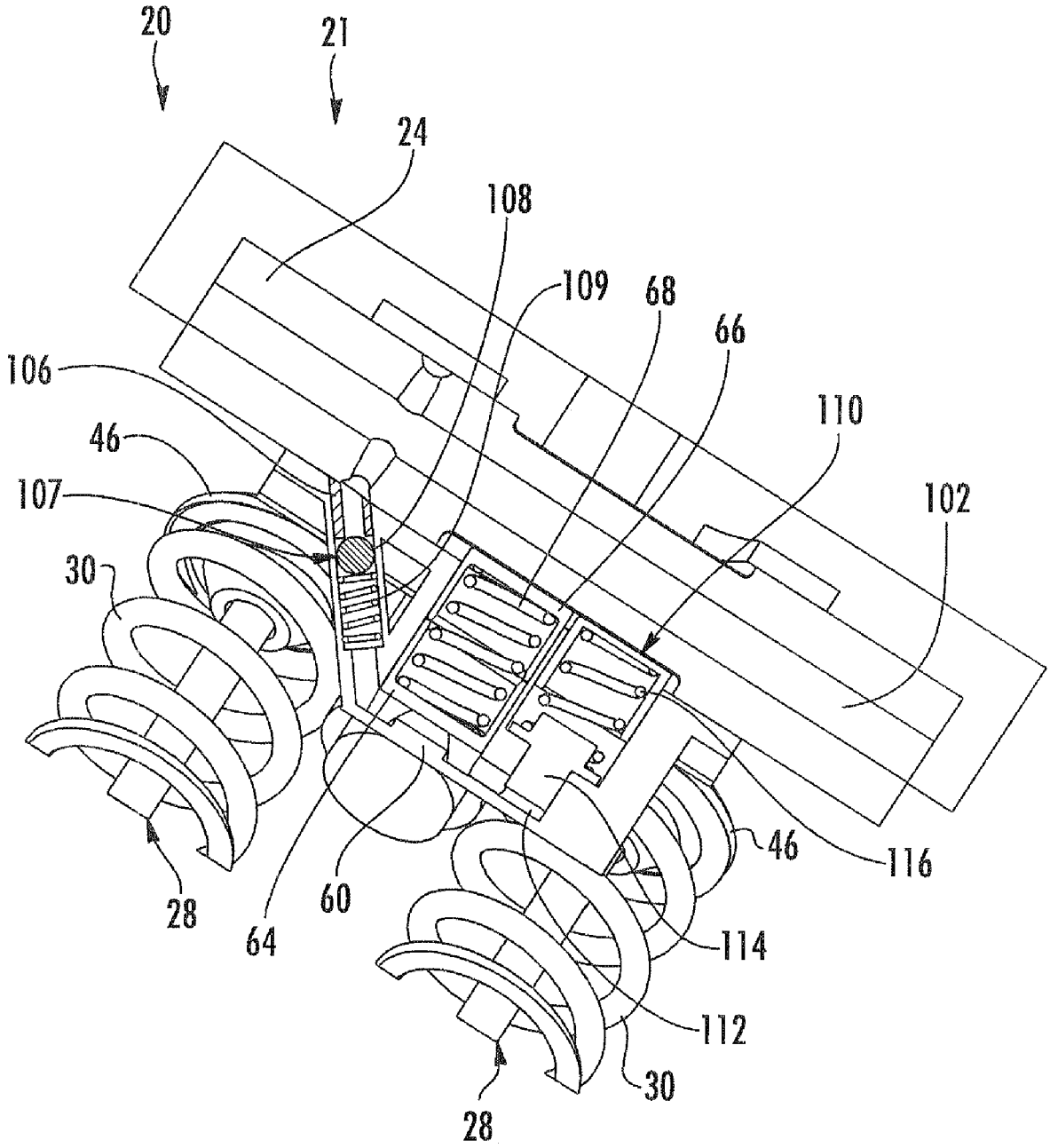
FIG. 6B is a sectional view of the embodiment of FIG. 6B in a dampening state.

FIGS. 6A and 6B illustrate engine 20 of FIG. 5 additionally including hydraulic damper 110. Like damper systems 80 and 82, hydraulic damper 110 dampen or decelerate the movement or acceleration of valves 28. In particular, when slave cylinder 64 reaches the end of its travel distance (when in contact with or abutment with slave cylinder stop 66) rocker arm 26 and valve(s) 28 accelerate rapidly to reach the opening rate that camshaft 22 dictates. The opening rate of the cam 37 at the limit of the travel of a slave cylinder 64 utilizes extremely high rocker arm and valve acceleration rates. Hydraulic damper 110 dampens this very high, short-term acceleration.

Hydraulic damper 110 includes a volume 112, a surge piston 114 and a surge spring 116. Volume 112 comprises a chamber, space or cavity extending adjacent to the volume of chamber 60. In the example illustrated, volume 112 is fluidly coupled to chamber 60. However, the spring force of spring 116 against the surge piston 114 is great enough to prevent any movement of the surge piston 114 until the slave cylinder 64 (also known as a slave piston) has reached the limit of its movement.

Surge piston 114 comprises a cylinder, plunger, or other structure movably supported adjacent to volume 112. Surge spring 116 comprises a compression spring captured against piston 114 and an opposite base structure. Spring 116 resiliently biases surge piston 114 towards volume 112 and towards a position in which surge piston 114 extends into and closes off a portion of volume 112 so as to reduce a volume of volume 112. Fluid pressure within volume number 112, such as when volume 112 receives fluid from chamber 60, moves surge piston 114 against spring 116 to increase the volume of volume 112.

FIG. 6B illustrates hydraulic damper 110 after hydraulic pressure has moved slave cylinder 64 to its end of travel against stop 66. Upon slave cylinder 64 reaching its end of travel, fluid pressure within volume 112 against surge piston 114 increases until exceeding the threshold spring force of spring 116 to move piston 114 against spring 116. As a result, when hydraulic pressure between plunger 52 (also known as a cam follower piston) and slave cylinder 64 is greater than a maximum pressure needed to fully move slave cylinder 64 to its end of travel as defined by stop 66, piston 114 is moved against spring 116. Spring 116 absorbs high pressure pulses that may occur as the rocker arm and valves 28 begin to open. Piston 114 moves a short distance as hydraulic pressure spikes at the instant the slave cylinder 64 reaches its end of travel distance are moved into abutment with stop 66. As the rocker arm and valve 28 accelerate and reach the opening rate of the camshaft 22, piston 114 (also known as a surge plunger) returns to its original position. By setting the relative diameter of piston 114 and the spring constant of spring 116, the acceleration rate of rocker arm 26 and valves 28 may be better controlled.

As noted above, the relative timing at which cylinder 64 and piston 114 move is largely controlled based on the spring constants of springs 68 and 116. Although hydraulic damper 110 is configured such that piston 114 does not move until cylinder 64 reaches its end of travel, in other embodiments, damper 110 may alternatively be configured such that piston 114 moves prior to cylinder reaching its end of travel position.

Although volume 112 is illustrated as always being fluidly coupled to chamber 60, in other embodiments, hydraulic damper 110 may be fluidly decoupled from the volume between the cam follower and the rocker arm prior to the motion being transmitted to move the valve. In particular, in other embodiments, slave cylinder 64 may be configured to interrupt fluid connection between chamber 60 and volume 112. In such an alternative embodiment, volume 112 becomes fluidly coupled to the volume of chamber 60 in response to or at the moment that slave cylinder 64 has reached its end of travel through by its abutment with stops 66. As such point in time, fluid within chamber 60 is permitted to flow into chamber 112 to move piston 114.

In the example illustrated, damper 110 is illustrated as utilizing a compression spring. In other embodiments, damper 110 may utilize other springs or other structures configured to resiliently bias piston 114 towards a position which piston 114 reduces the volume of volume 112. Although damper 110 is illustrated as being utilized with damper systems 80 and 82, in other embodiments, damper 110 may be utilized with one of systems 80, 82 or may be utilized without either of systems 80, 82.

Overall, the valve opening and closing system 21 of engine 20 provides enhanced control over valve lift and duration by an engine control unit 110 (shown in FIG. 4). Engine control unit 110 may control the amount of dwell or lost motion through use of lost motion adjuster 36. In the example illustrated, engine control unit 110 selectively rotates rocker arm shaft 24 to rotate eccentric 74 to control the extent of lost motion and dwell. When greater valve lift and longer opening duration are desired, the slave cylinder range of motion (dwell or lost motion) may be reduced. Likewise, when a reduced valve lift and shorter opening duration is desired, the slave cylinder range of motion (lost motion, or dwell) may be increased. The slave cylinder range of motion may be altered continuously during engine operation in response to such factors as throttle position, engine speed and manifold air pressure. As a result, the valve lift and duration may be controlled to provide enhanced power, efficiency and emission levels.

The ability to open and close both the intake and exhaust valves at a desired point relative to the position of the piston of the internal combustion engine 20 enables engine 20 to achieve optimum and precise performance at all speeds and load conditions. For example, during idling conditions, the exhaust valve may be kept open during the normal intake stroke so that some exhaust gases are drawn into the engine and less air and fuel is consumed. When starting the engine, the intake valve may be kept open as the compression stroke begins to allow some of the fresh air to be forced back into the intake port, thus lowering the engine compression and reducing the required starting power. An easier starting and smoother idling engine may be achieved to provide lower fuel consumption and reduced emissions.

Figure 7:
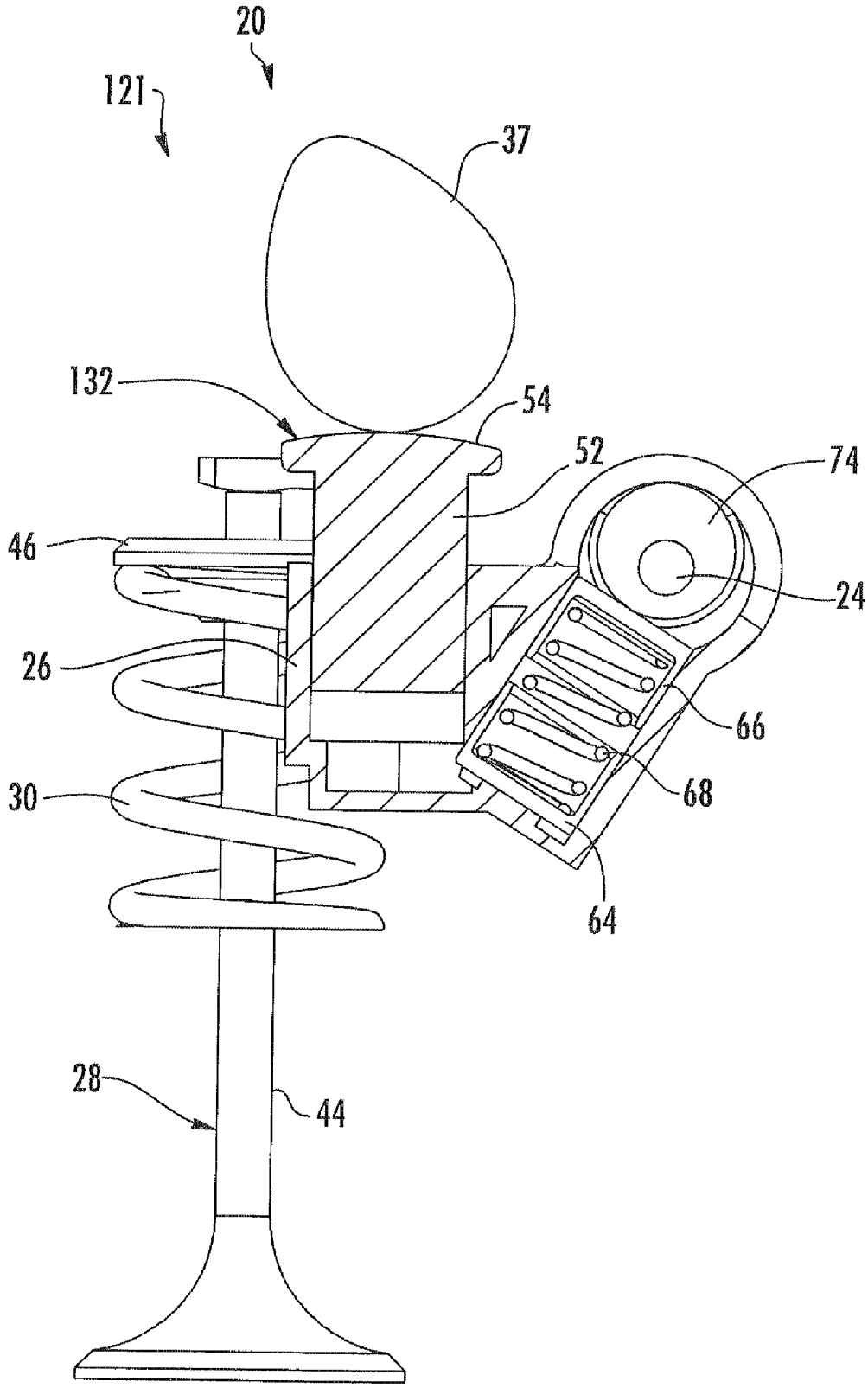
FIG. 7 is a sectional view of another embodiment of the system of FIG. 1.

FIG. 7 illustrates valve control system 121, another embodiment of valve control system 21. Valve control system 121 is substantially identical to valve control system 21 except that system 121 includes cam follower 132 in lieu of cam follower 32. As shown by FIG. 7, cam follower 132 includes a plunger 52 and head portion 54 in engagement with cam 37 camshaft 22. The remaining structures and the operation of system 121 are identical to system 21.

Figure 8:
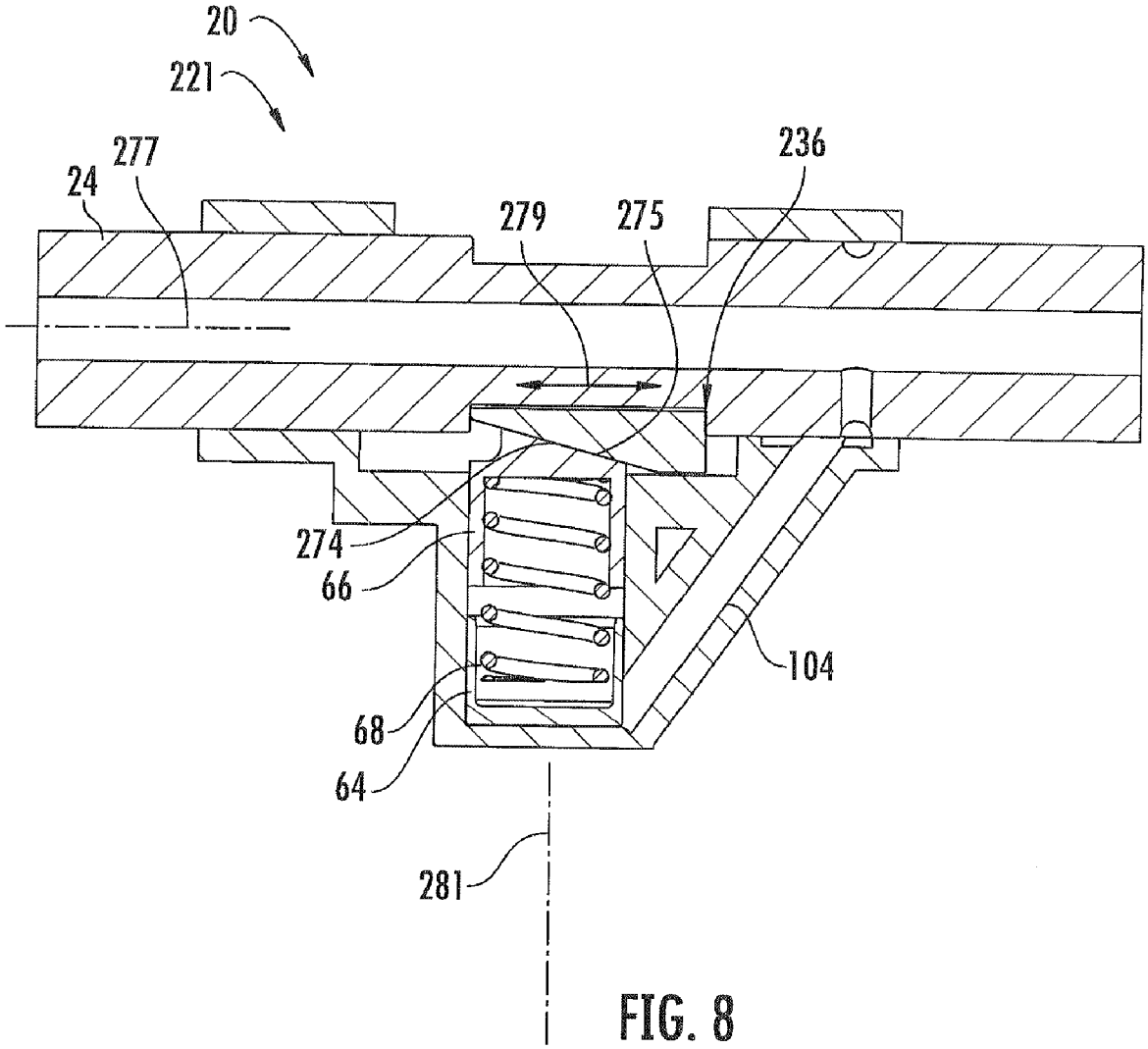
FIG. 8 is a sectional view of another embodiment of the system of FIG. 1.
Figure 9:
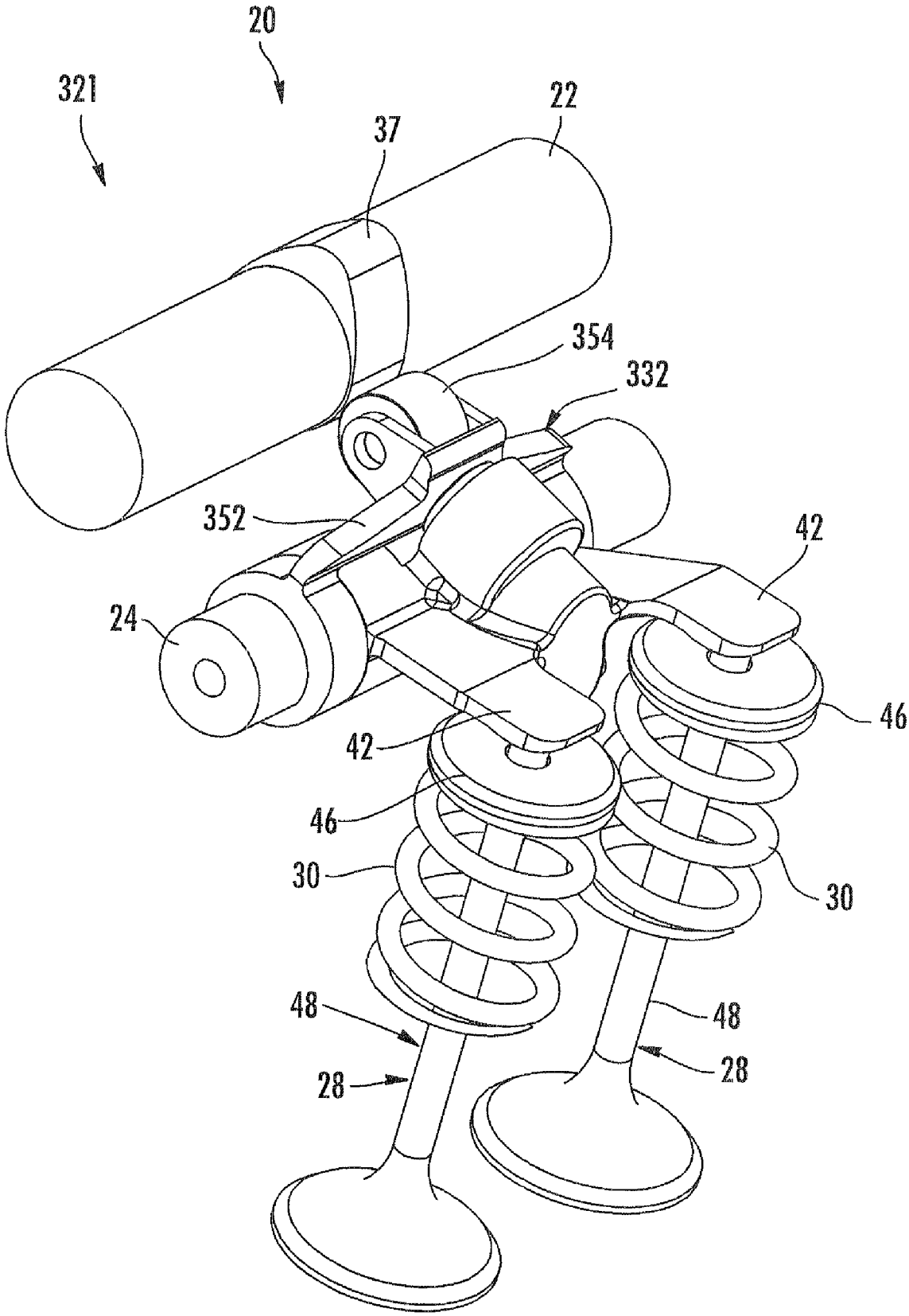
FIG. 9 is a fragmentary perspective view of another embodiment of the system of FIG. 1.
Figure 10:
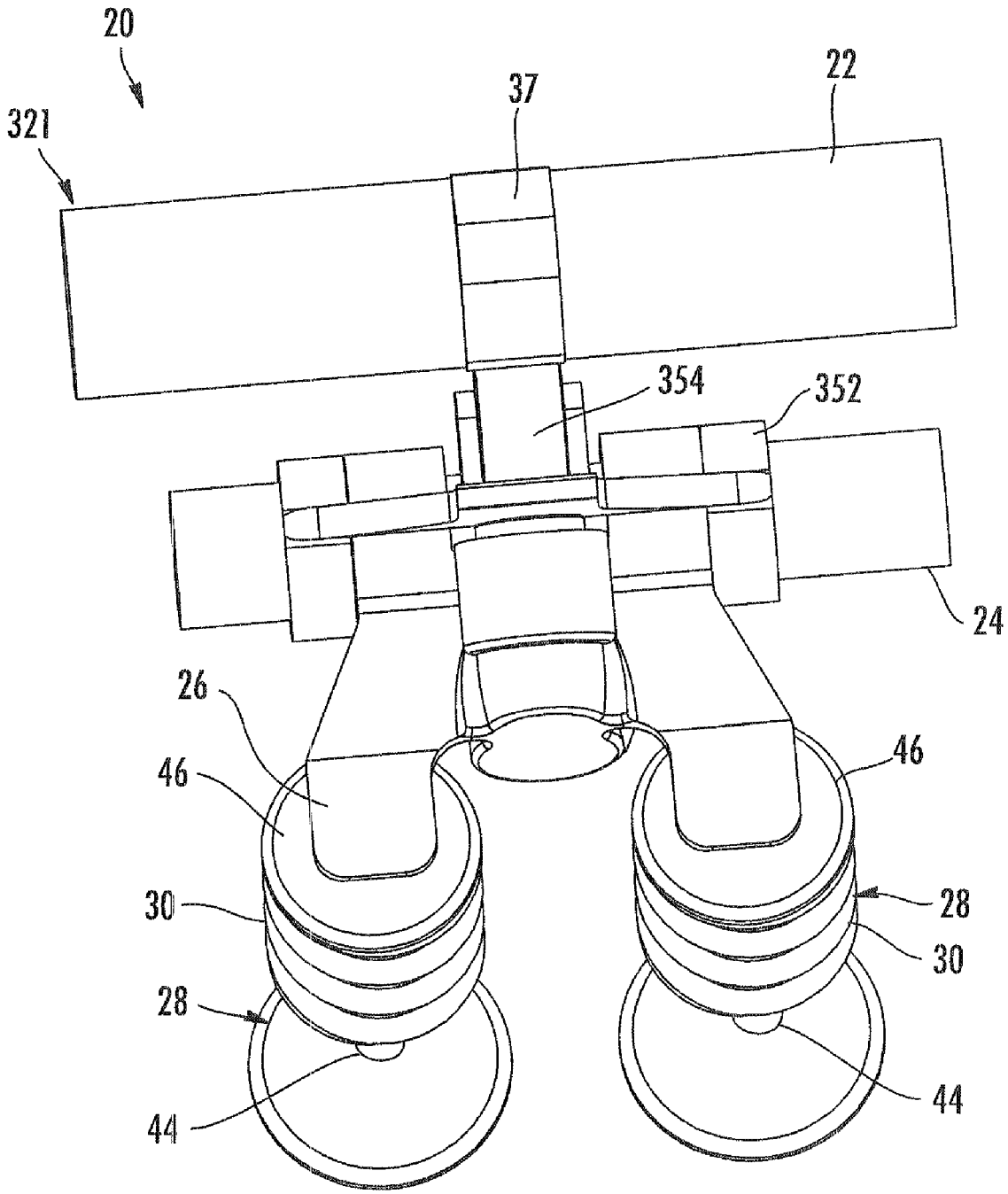
FIG. 10 is a front perspective view of the system of FIG. 9.
Figure 11:
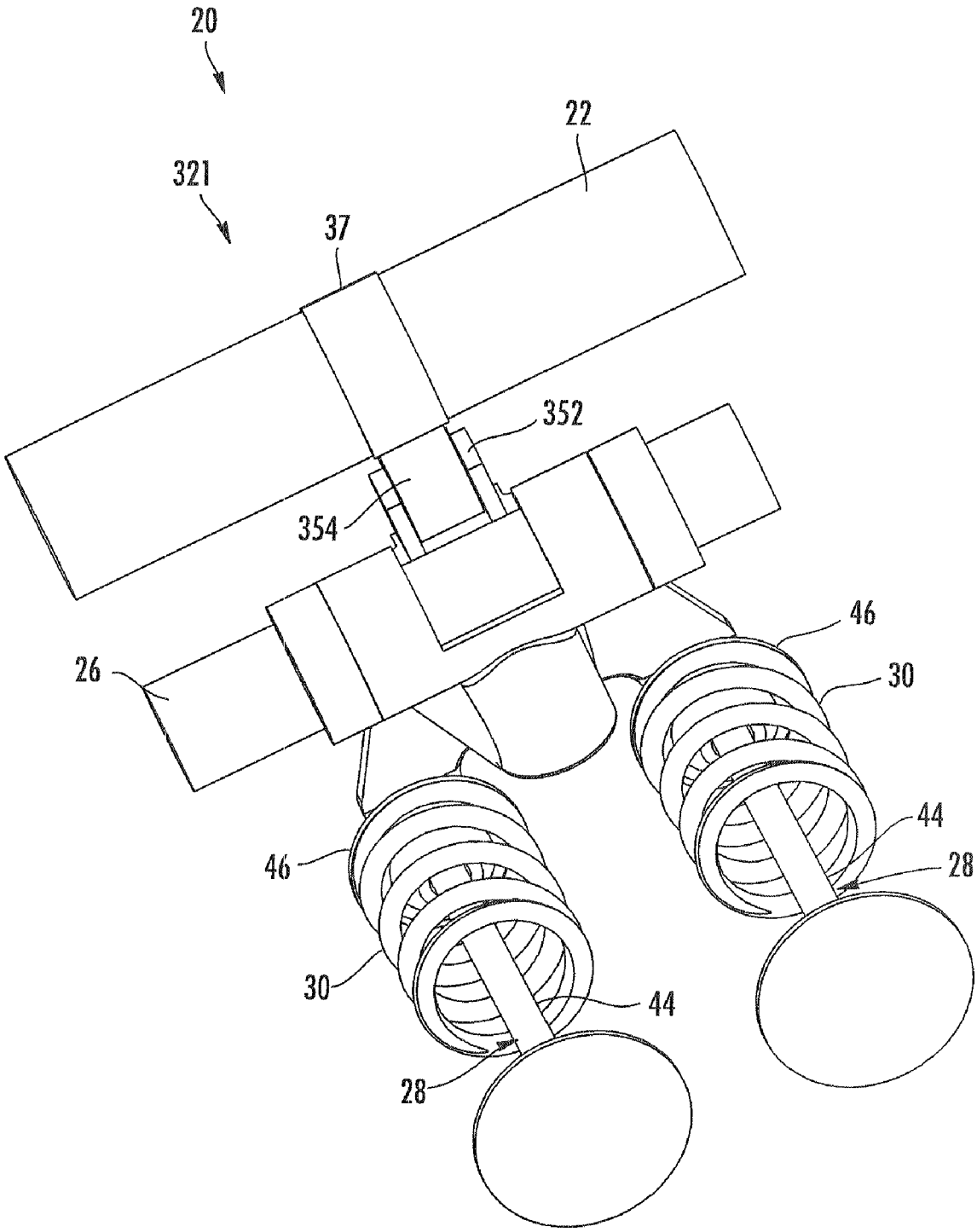
FIG. 11 is a rear perspective view of the system of FIG. 9.
Figure 12:
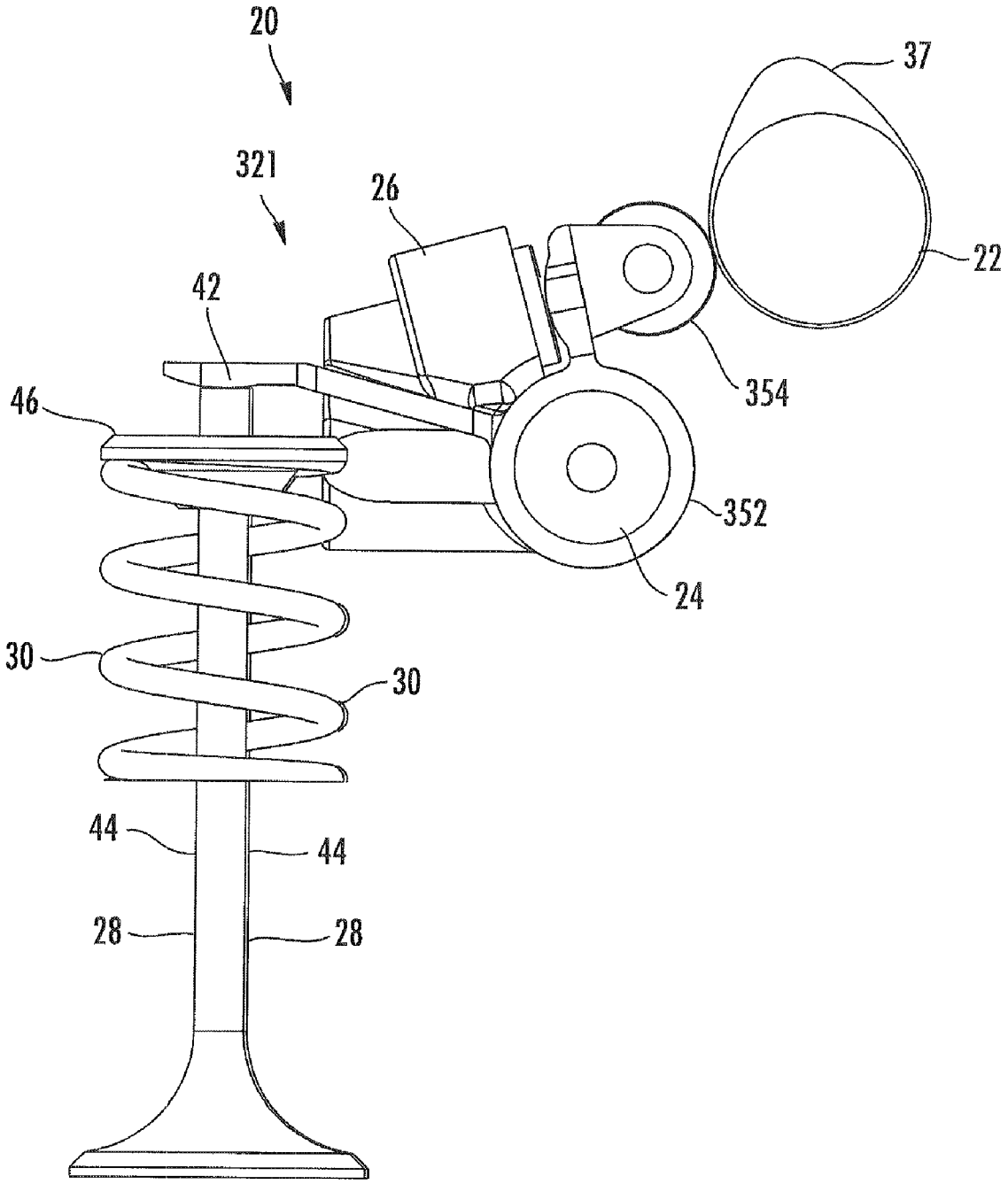
FIG. 12 is a side elevational view of the system of FIG. 9.

FIG. 8 illustrates valve control system 221, another embodiment of valve control system 21. Valve control system 221 is similar to valve control system 21 except that system 221 includes lost motion adjuster 236 in lieu of lost motion adjuster 36. Those remaining components of system 221 are substantially identical to components of system 21 (shown in FIGS. 1-5).

As shown by FIG. 8, lost motion adjuster 236 includes a first ramp surface 274 associated with stop 66 and a second ramp or tapered surface 275 coupled to rocker arm shaft 24. Rocker arm shaft 24 is configured to be manually translated or moved along axis 277 in either direction as indicated by arrows 279 by an actuator (not shown) such as a hydraulic piston-cylinder assembly, a pneumatic cylinder-piston assembly, an electric solenoid or other powered translation device under control of engine control unit 110 (shown in FIG. 4). Movement of rocker arm shaft 24 along axis 277 causes surface to 75 to interact with surface to 74 to translate stop 66 along axis 281. As with system 21, adjusting the position of stop 66 relative to cylinder 64 to adjust the permissible range of motion, dwell or lost motion of cylinder 64.

FIGS. 9-13 illustrate a control system 321, another embodiment of the control system 21. Valve control system 321 is part of an internal combustion engine 20. Valve control system 321 is substantially identical to valve control system 21 except that system 321 further includes master piston 331 and cam follower 332 in lieu of cam follower 32.

Figure 13:
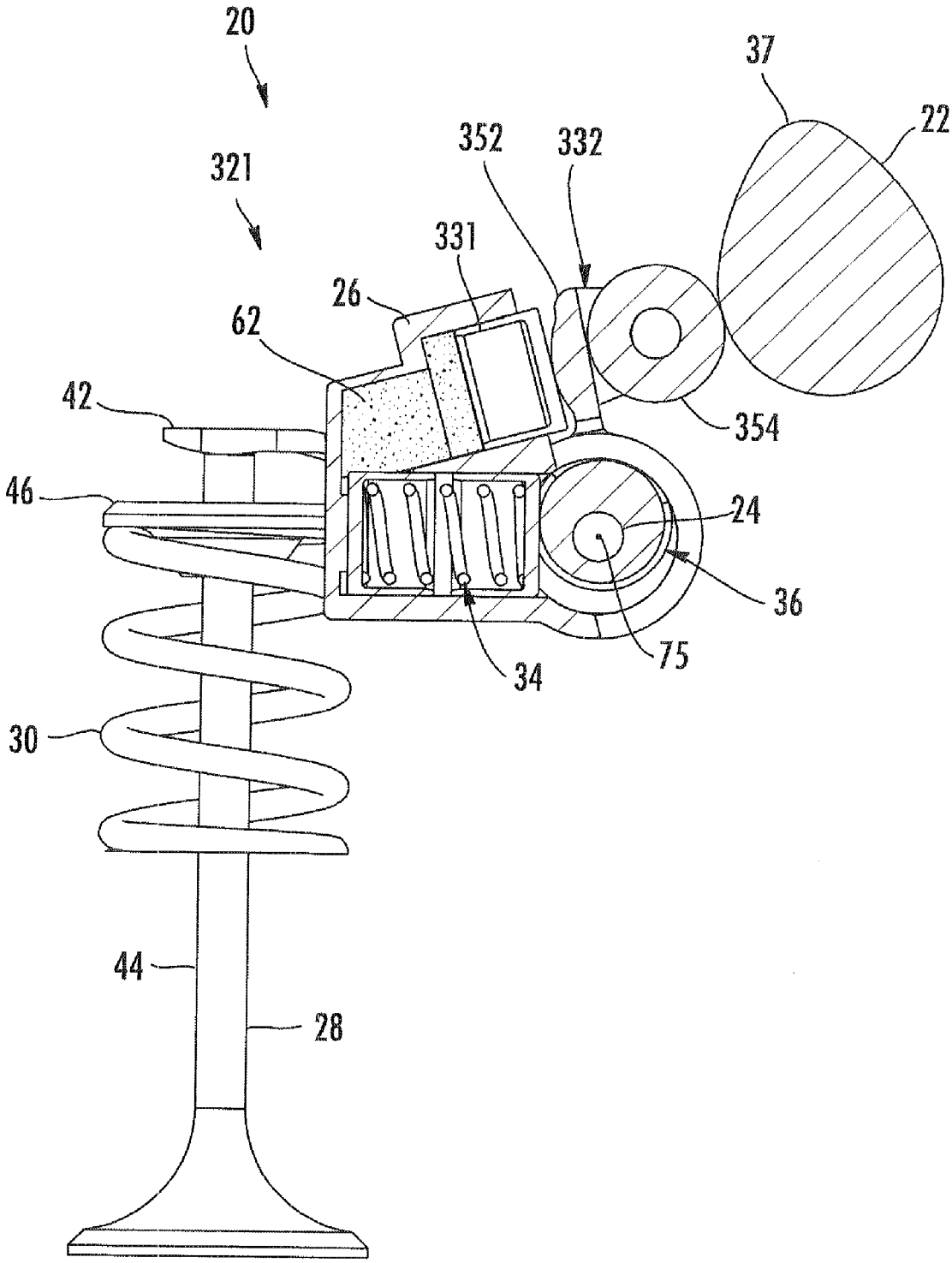
FIG. 13 is a sectional view of the system of FIG. 9.

Master piston 331 (shown in FIG. 13) is slidably supported within rocker arm 26 adjacent hydraulic fluid 62 (shown in FIG. 13). Master piston 331 is configured to be contacted by cam follower 332.

Cam follower 332 comprises a structure configured to move in response to rotation of camshaft 22. Cam follower 32 is further configured to move relative to rocker arm 26 as the established dwell or lost motion provided by lost motion mechanism 34 is consumed and to transmit motion to rocker arm 26 such that rocker arm 26 moves with cam follower 32 after the lost motion or dwell has been consumed. Cam follower 332 is operably coupled between cam 37 of cam shaft 22 and rocker arm 26. Cam follower 332 is operably coupled to rocker arm 26 by lost motion mechanism 34.

In the particular example illustrated, cam follower 332 comprises hammer 352 and roller 354. Hammer 352 comprises a structure configured to contact main piston 331 to drive main piston 331 into chamber 60 as cam follower 332 is driven by camshaft 22. Hammer 352 is external to rocker arm 26 and is pivotable with respect to rocker arm 26. In the example illustrated, hammer 352 pivots about rocker arm shaft 24. In other embodiments, cam follower 332 may pivot about other axes or be supported by other supporting structures.

Roller 354 comprises a wheel or roller rotationally supported by hammer 352 opposite to and in engagement with cam 37 of camshaft 22. Roller 354 rotates in response to rotation of camshaft 22 and exerts a linear force or translation to master piston 331 to move piston 331. In other embodiments, cam follower 332 may have other configurations.

Figure 14:
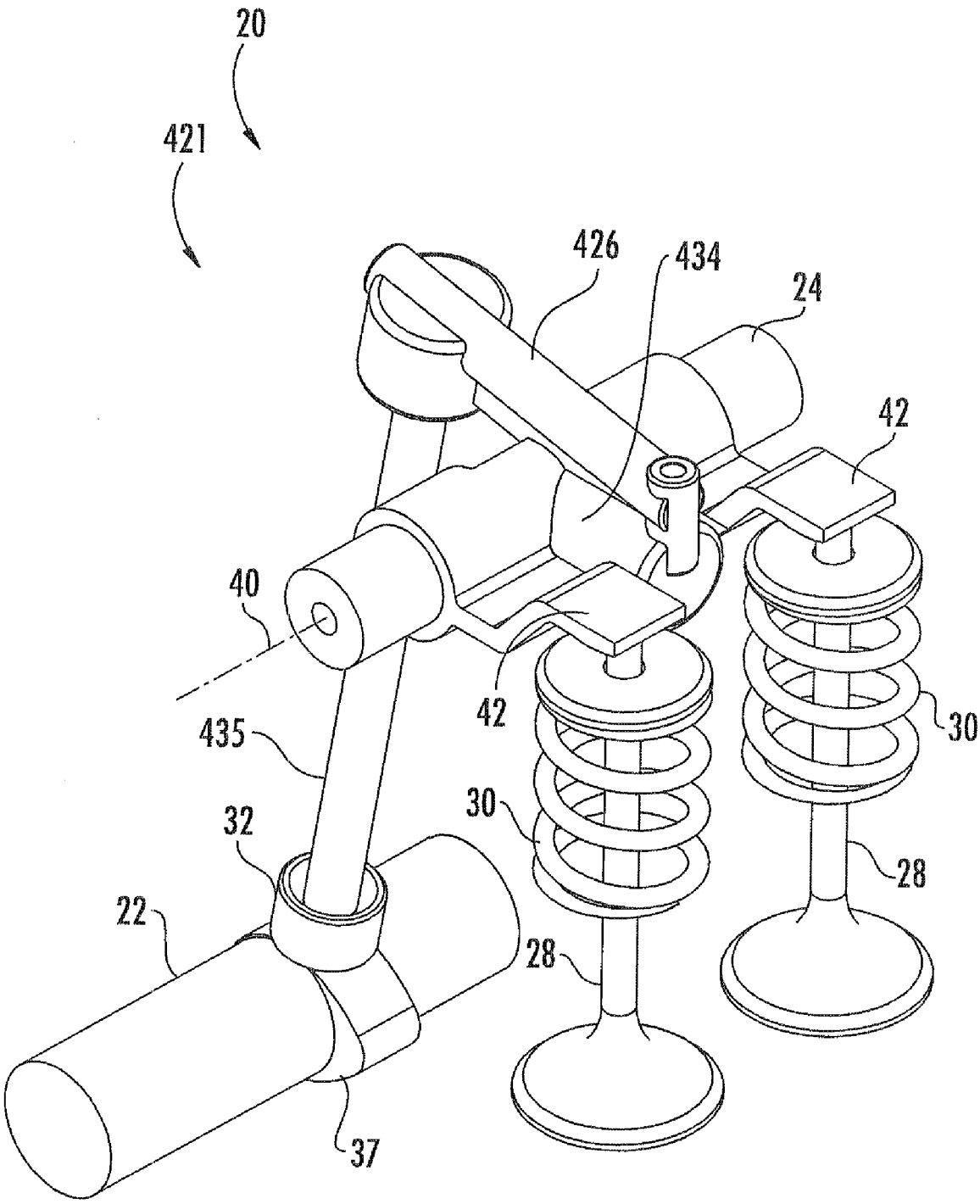
FIG. 14 is a fragmentary perspective view of another embodiment of the system of FIG. 1.
Figure 15:
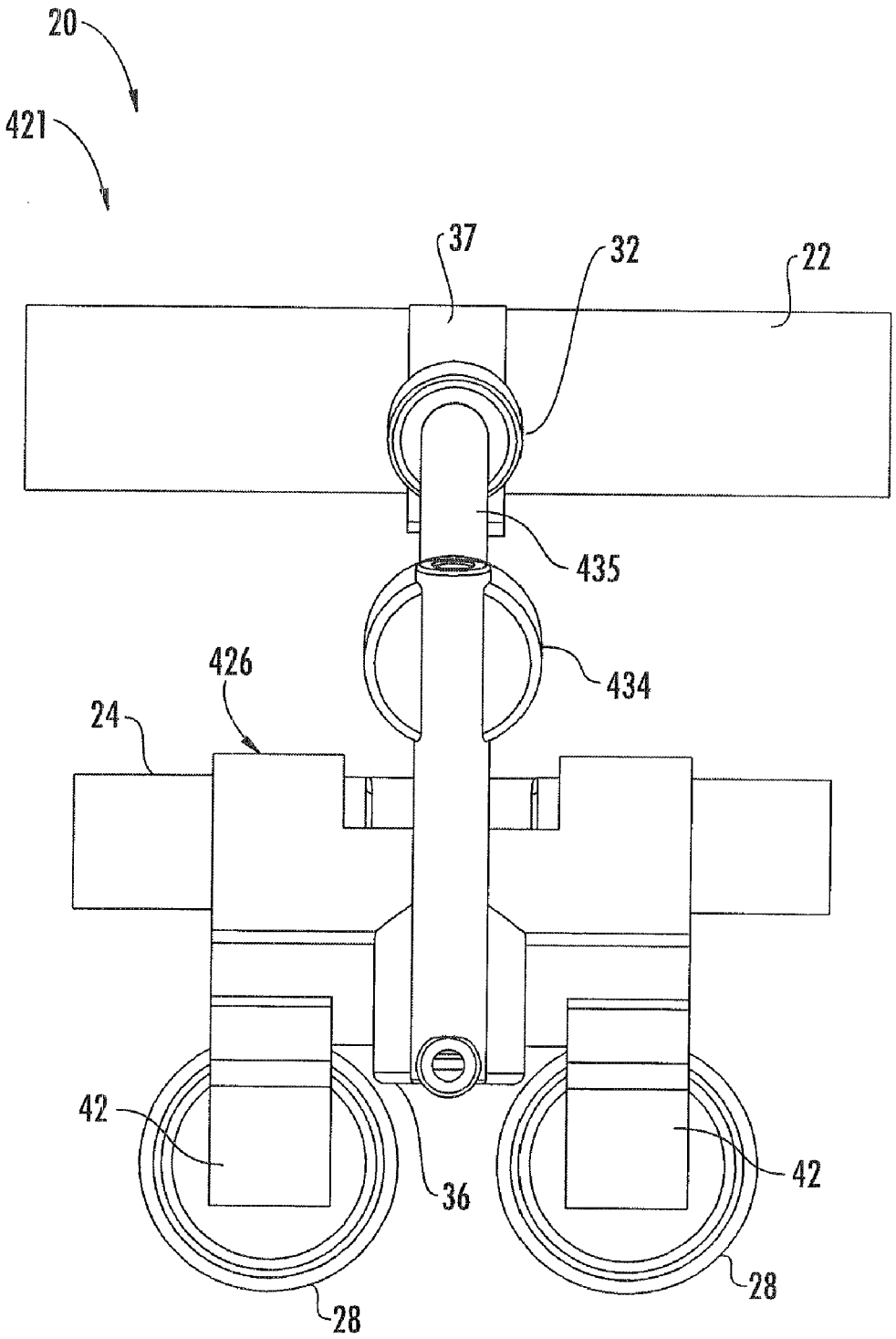
FIG. 15 is a top perspective view of the system of FIG. 14.
Figure 16:
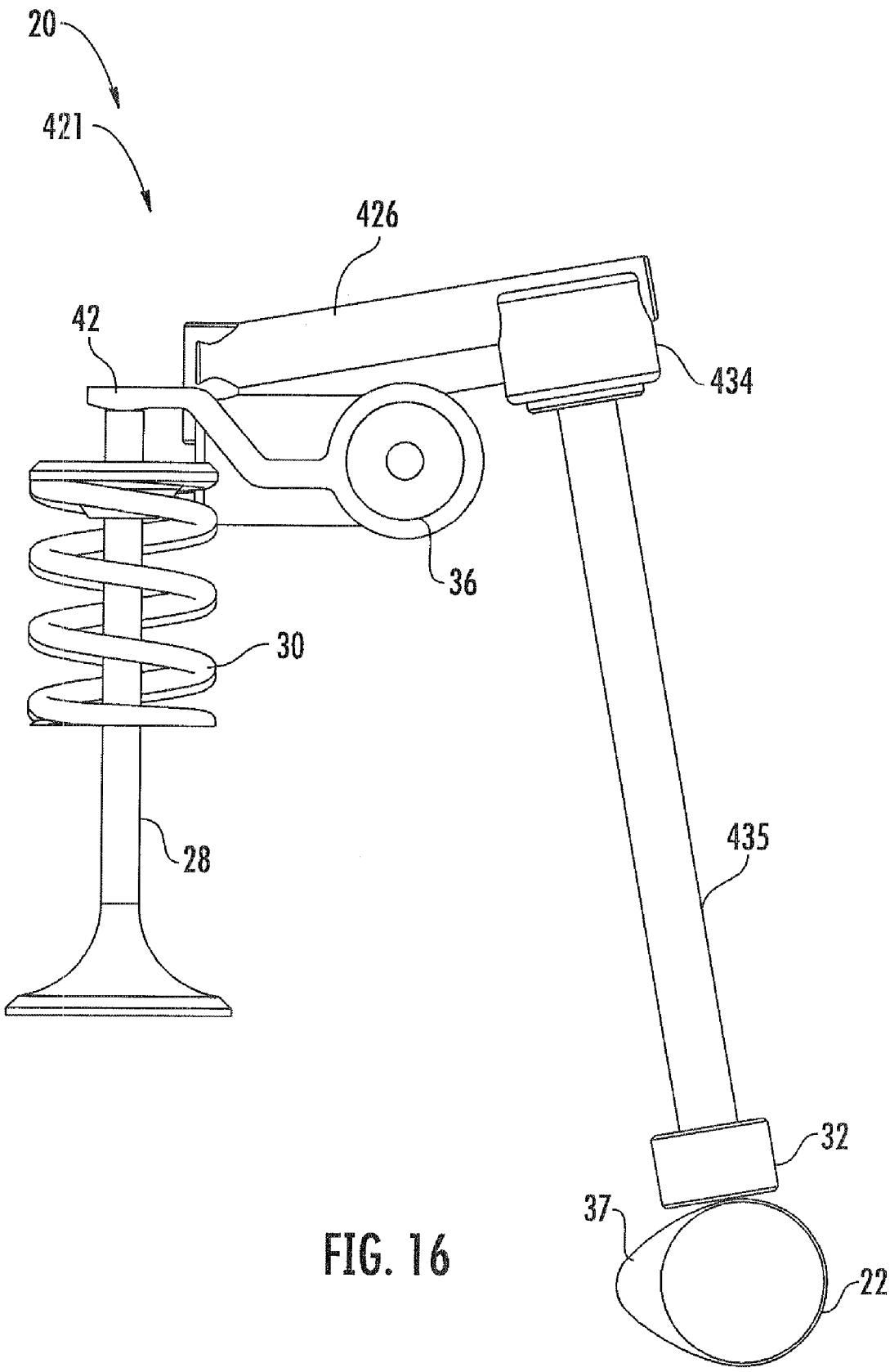
FIG. 16 is a side elevational view of the system of FIG. 14.
Figure 17:
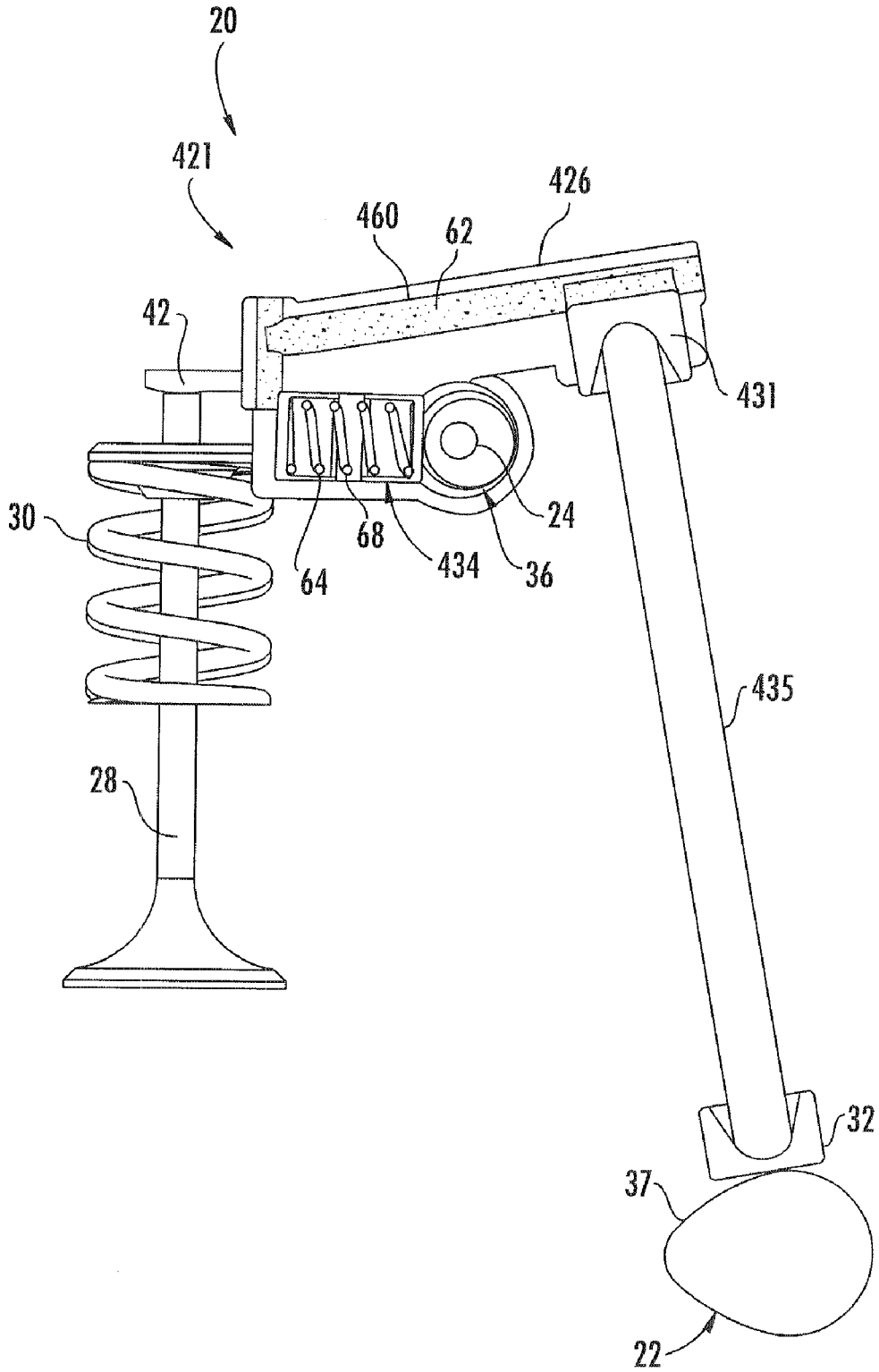
FIG. 17 is a sectional view of the system of FIG. 14.

FIGS. 14-17 illustrate control system 421, another embodiment of control system 21 of engine 20. FIG. 14 top perspective view of system 421. FIG. 15 is a top plan view of control system 421. FIG. 16 is a side elevation overview of control system 421. FIG. 17 is a sectional view of control system 421. Control system 421 is similar to control system 21 except that control system 421 includes rocker arm 426 and lost motion mechanism 434 in place of rocker arm 26 and lost motion mechanism 34, respectively, and that control system 421 additionally includes push rod 435. Those remaining elements or components of control system 421 which correspond to elements of control system 21 are numbered similarly.

Rocker arm 426 is similar to rocker arm 26 except that rocker arm 426 is specifically configured to accommodate lost motion mechanism 434 and push rod 435. Like rocker arm 26, rocker arm 426 comprises one or more structures configured to pivot about axis 40 so as to move valves 28. Rocker arm 426 is operably coupled to cam follower 32 by lost motion mechanism 434 and push rod 435 such that after lost motion provided by lost motion mechanism 434 has been consumed, further motion or movement of cam follower 32 results in rocker arm 426 pivoting about axis 40 to move valves 28. In the example illustrated, rocker arm 426 includes a pair of fingers or extensions 42 in engagement with a pair of valves 28. In other embodiments, rocker arm 426 may include a single extension 42 or greater than two such extensions 42. In other embodiments, rocker arm 426 may have configurations other than that shown.

Lost motion mechanism 434 similar to lost motion mechanism 34 except that mechanism 434 includes fluid chamber 460 (shown in FIG. 17) in place of chamber 60 and additionally includes piston 431. Fluid chamber 460 extends from slave cylinder 64 through rocker arm 426 to piston 431. Piston 431 is slidably supported adjacent to chamber 460 such that movement of piston 431 moves hydraulic fluid 62 against slave cylinder 64 and against the biases spring 68 or way from slave cylinder 64. Piston four and 31 is operably coupled to push rod 435.

Push rod 435 comprises an elongate rod operably coupled between piston 431 and cam follower 32. In the example illustrated, push rod 435 has opposite ends pivotably connected to cam follower 32 and piston 431. In other embodiments, push rod 434 may have other configurations or may be omitted.

Like system 21, valve opening and closing system 421 of engine 20 provides enhanced control over valve lift and duration by an engine control unit 110 (shown in FIG. 4). Engine control unit 110 may control the amount of dwell or lost motion through use of lost motion adjuster 36. In the example illustrated, engine control unit 110 selectively rotates rocker arm shaft 24 to rotate eccentric 74 to control the extent of lost motion and dwell. When greater valve lift and longer opening duration are desired, the slave cylinder range of motion (dwell or lost motion) may be reduced. Likewise, when a reduced valve lift and shorter opening duration is desired, the slave cylinder range of motion (lost motion or dwell) may be increased. The slave cylinder range of motion may be altered continuously during engine operation in response to such factors as throttle position, engine speed and manifold air pressure. As a result, the valve lift and duration may be controlled to provide enhanced power, efficiency and emission levels.

Figure 18:
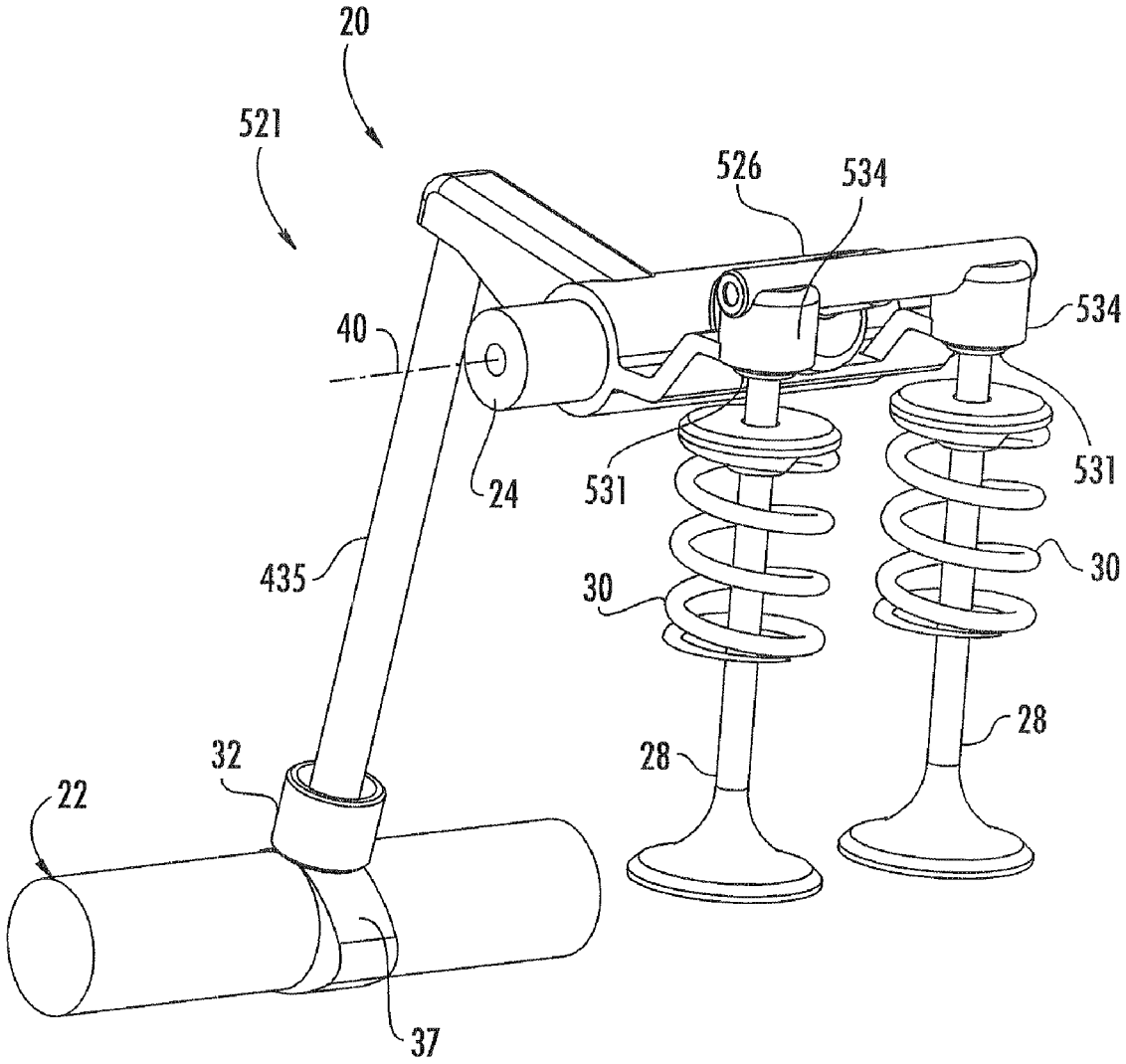
FIG. 18 is a fragmentary perspective view of another embodiment of the system of FIG. 1.
Figure 19:
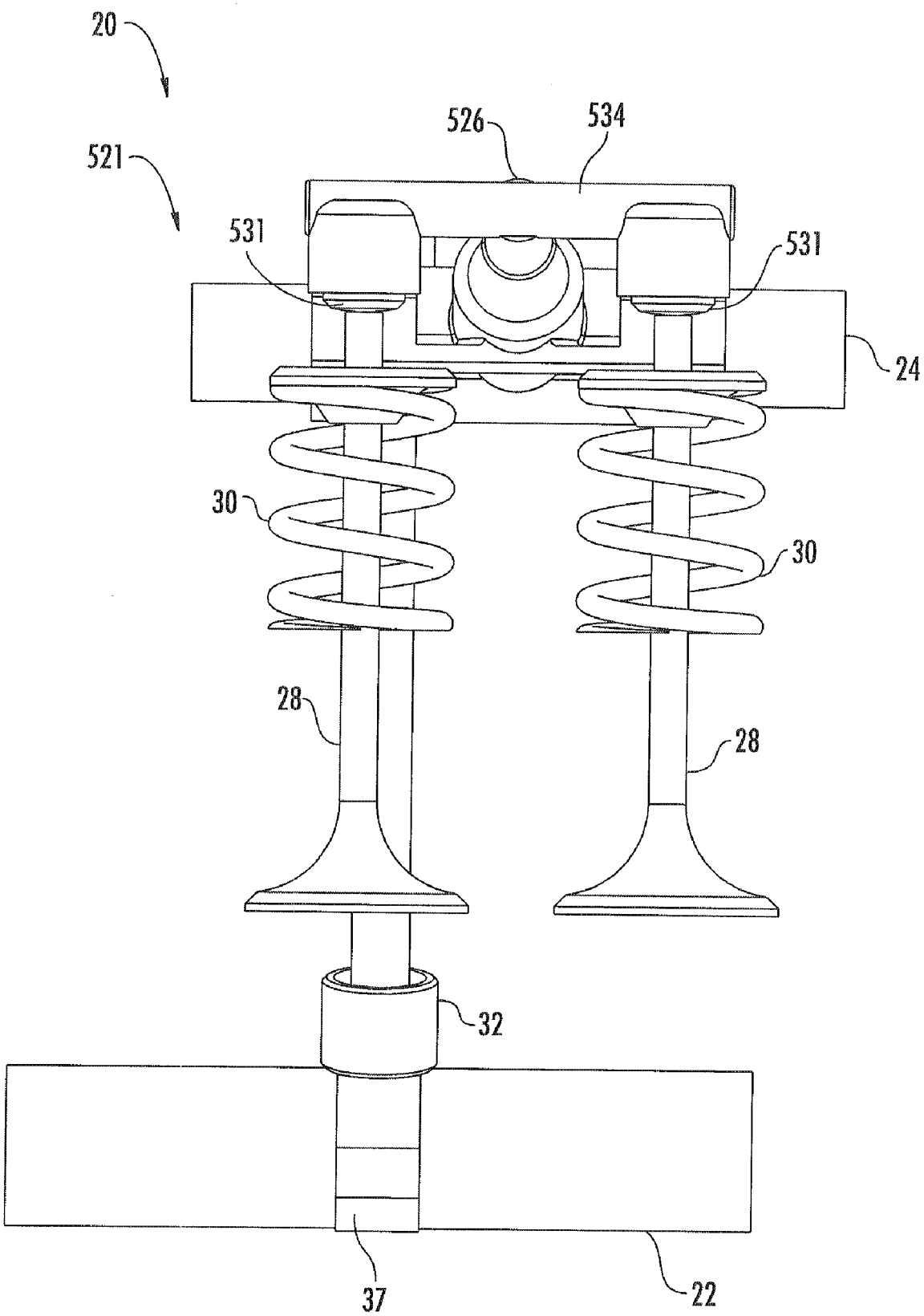
FIG. 19 is a front perspective view of the system of FIG. 18.
Figure 20:
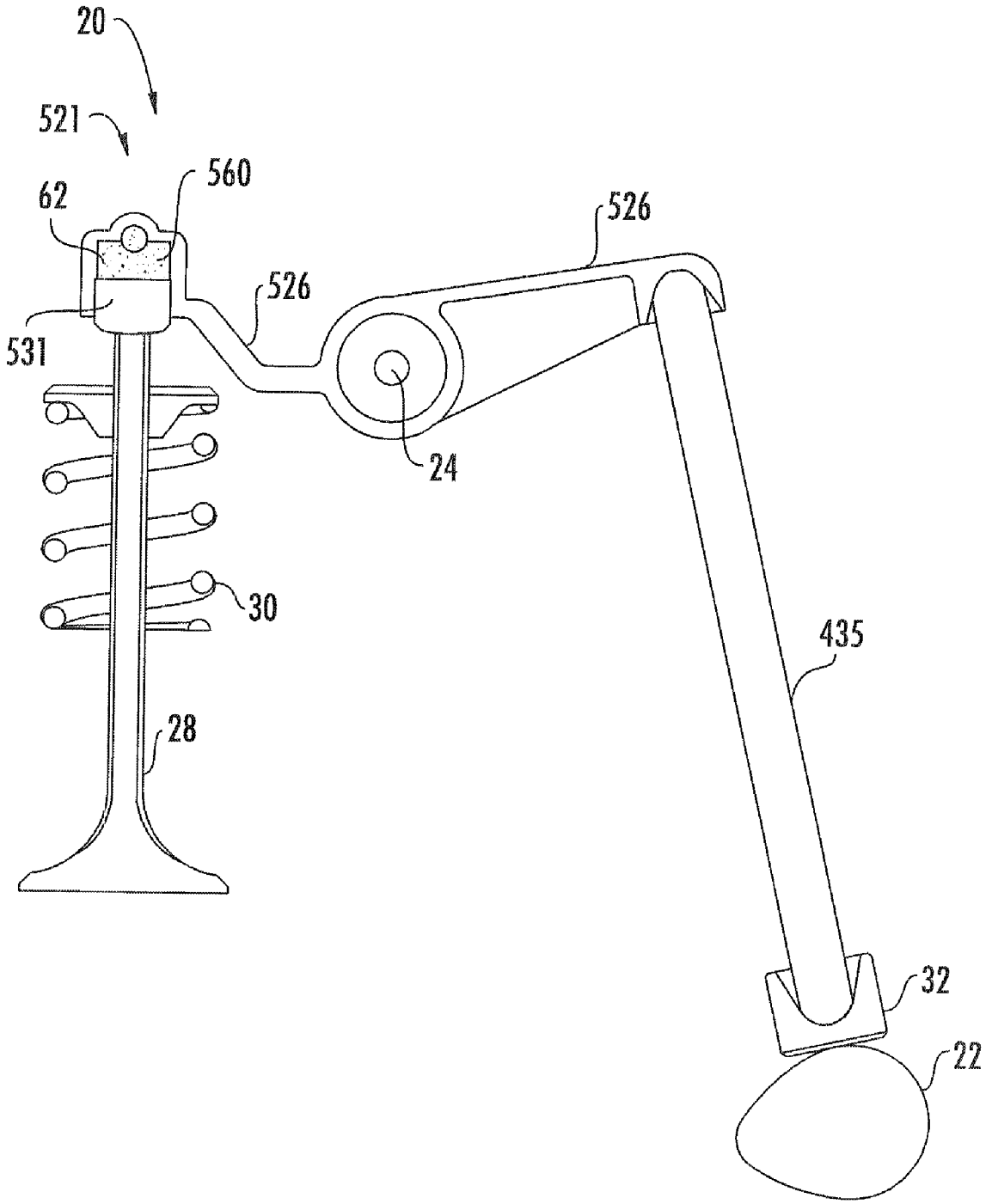
FIG. 20 is a first side sectional view of the system of FIG. 18.
Figure 21:
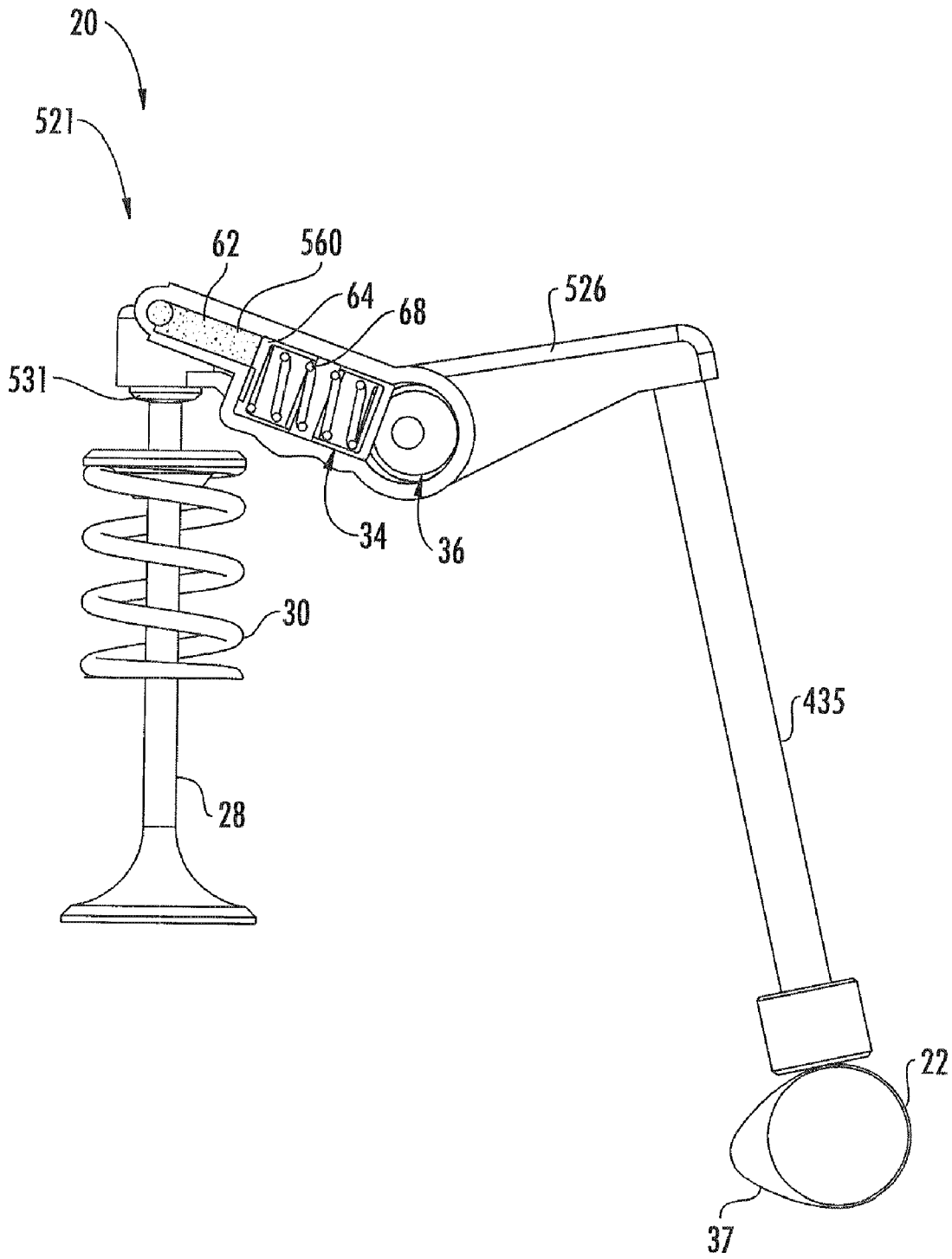
FIG. 21 is a second side sectional view of the system of FIG. 18.
Figure 22:
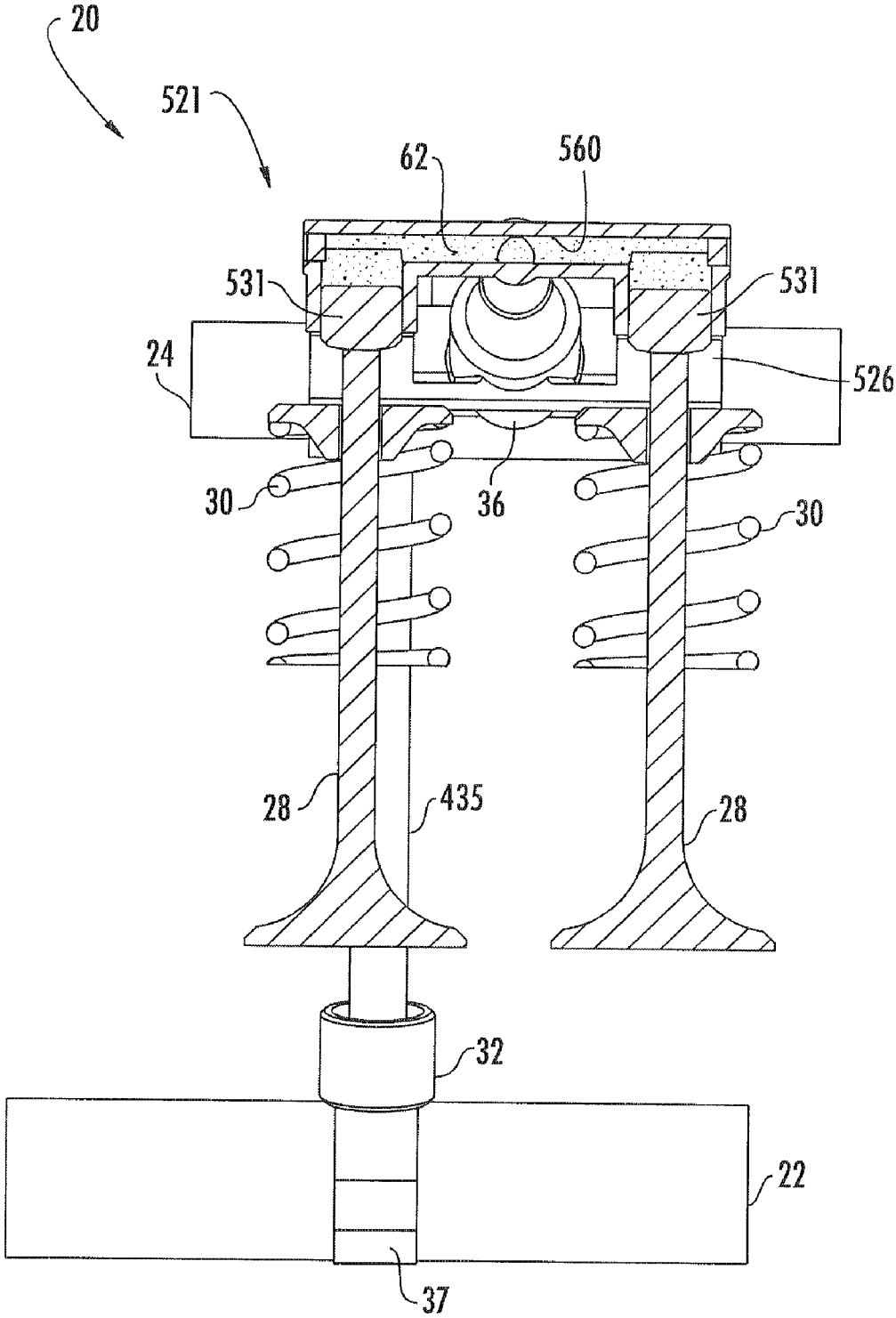
FIG. 22 is a front sectional view of the system of FIG. 18.

FIGS. 18-22 illustrate system 521, another embodiment of system 21 of engine 20. FIG. 18 is a perspective view of control system 521. FIG. 19 is a front elevation overview of control system 521. FIG. 20 is a side sectional view of control system 521. FIG. 21 is a second side sectional view of control system 521. FIG. 22 is a front sectional view of control system 521. Valve opening and closing control system 521 is similar to control system 421 except that control system 521 includes rocker arm 526 and lost motion mechanism 534 in place of rocker arm 426 and lost motion mechanism 434, respectively. Those remaining elements or components of control system 521 which correspond to elements of control system 421 are numbered similarly.

Rocker arm 526 is similar to rocker arm 426 except that rocker arm 526 is specifically configured to accommodate lost motion mechanism 534 and push rod 435. Like rocker arm 426, rocker arm 526 comprises one or more structures configured to pivot about axis 40 so as to move valves 28. Rocker arm 526 is operably coupled to cam follower 32 by lost motion mechanism 434 and push rod 435 such that after lost motion provided by lost motion mechanism 534 has been consumed, further motion or movement of cam follower 32 results in rocker arm 526 pivoting about axis 40 to move valves 28. In the example illustrated, rocker arm 526 includes a pair of fingers or extensions 42 in engagement with a pair of valves 28. In other embodiments, rocker arm 426 may include a single extension 42 or greater than two such extensions 42. In other embodiments, rocker arm 526 may have configurations other than that shown.

Lost motion mechanism 534 is similar to lost motion mechanism 434 except that mechanism 534 includes fluid chamber 560 (shown in FIGS. 20-22) in place of chamber 460 and includes pistons 531 in place of piston 431. As shown by FIG. 20, push rod 435 is directly pivotally connected to rocker arm 526 without an intervening piston 431.

Fluid chamber 560 extends from slave cylinder 64 through rocker arm 526 to pistons 531. Pistons 531 are secured to an end of valves 28. Pistons 531 are slidably supported adjacent to chamber 560 by rocker arm 526 such that pivotal movement of rocker arm 526 moves hydraulic fluid 62 within chamber 560 against slave cylinder 64 and against the bias spring 68 or away from slave cylinder 64.

In operation, pivotal movement of rocker arm 526, brought about by the interaction between camshaft 22 and cam follower 32, compresses hydraulic fluid 62 against slave cylinder 64 and against the bias provided by spring 68 to move the slave cylinder 64 until spring 68 can no longer be compressed (as adjustably controlled by mechanism 36). Once rocker arm 526 has been sufficiently rotated such that this dwell or lost motion has been consumed, further pivotal movement of rocker arm 526 results in motion being transmitted to one or both of pistons 531 to move valves 28.

Like system 21, valve opening and closing system 521 of engine 20 provides enhanced control over valve lift and duration by an engine control unit 110 (shown in FIG. 4). Engine control unit 110 may control the amount of dwell or lost motion through use of lost motion adjuster 36. In the example illustrated, engine control unit 110 selectively rotates rocker arm shaft 24 to rotate eccentric 74 to control the extent of lost motion and dwell. When greater valve lift and longer opening duration are desired, the slave cylinder range of motion (dwell or lost motion) may be reduced. Likewise, when a reduced valve lift and shorter opening duration is desired, the slave cylinder range of motion (lost motion or dwell) may be increased. The slave cylinder range of motion may be altered continuously during engine operation in response to such factors as throttle position, engine speed and manifold air pressure. As a result, the valve lift and duration may be controlled to provide enhanced power, efficiency and emission levels.

Although FIGS. 1-17 illustrate first variations where the cam follower is coupled between the rocker arm and the camshaft so as to move relative to the rocker arm through the adjustable distance prior to transmitting motion from the camshaft to the rocker arm to pivot the rocker arm while FIGS. 18-22 illustrates a second variation where the rocker arm is coupled between the cam follower and the valve so as to move relative to the valve through an adjustable distance prior to transmitting motion to the valve to pivot the valve, in other embodiments, a valve opening and closing control system may alternatively include the lost motion mechanisms of both the first and second variations. For example, in another embodiment, system 521 may additionally include piston 431 slidably received within rocker arm 526 adjacent to chamber 560 and pivotally connected to push rod 435. Similar adaptations may be made to control systems 21, 121 count to 21 and 321 so as to alternatively or additionally include lost motion mechanism 434 and/or 534.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. An internal combustion engine comprising:

a cam shaft;

a valve;

a cam follower coupled between the cam shaft and the valve;

a piston to convert pressure transmitted from the cam shaft into hydraulic pressure;

a slave cylinder between the camshaft and the valve and movable in response to the hydraulic pressure; and a rocker arm coupled between the cam follower and the valve, wherein at least one of the cam follower and the rocker arm is configured so as to move through an adjustable distance prior to transmitting motion for moving the valve, the adjustable distance provided by an adjustable second distance in which the slave cylinder is movable.

2. The engine of claim 1, wherein the cam follower is coupled between the rocker arm and the camshaft so as to move relative to the rocker arm through the adjustable distance prior to transmitting motion from the cam shaft to the rocker arm to pivot the rocker arm.

3. The engine of claim 1, wherein the cam follower is operably coupled to the rocker arm by a hydraulic fluid contained in a volume between the cam follower and the rocker arm.

4. The engine of claim 3, wherein the piston is slidably coupled to the rocker arm between the hydraulic fluid and the cam follower.

5. The engine of claim 3 further comprising a fluid passage configured to add additional hydraulic fluid or remove portions of the hydraulic fluid.

6. The engine of claim 3, wherein the slave cylinder is movably supported adjacent to the volume.

7. The engine of claim 6, wherein the piston is slidably coupled to the rocker arm between the hydraulic fluid and the cam follower.

8. The engine of claim 6, wherein the slave cylinder is spring-loaded.

9. The engine of claim 6, further comprising an eccentric shaft operably coupled to a slave cylinder stop to adjust positioning of the slave cylinder stop.

10. The engine of claim 6 further comprising a tapered ramp operably coupled to the slave cylinder stop to adjust positioning of the slave cylinder stop.

11. The engine of claim 6 further comprising:

a slave cylinder stop; and a damper between the slave cylinder and the slave cylinder stop.

12. The engine of claim 11, wherein the damper comprises a Belleville spring.

13. The engine of claim 3 further comprising:

a hydraulic damper fluidly coupled to the volume between the cam follower and the rocker arm.

14. The engine of claim 13, wherein the hydraulic damper comprises:

a surge piston; and a surge piston spring resiliently biasing the surge piston.

15. The engine of claim 14, wherein the slave cylinder is movably supported adjacent to the volume and wherein the engine further comprises:

a slave cylinder stop; and a slave spring resiliently biasing the slave cylinder away from the stop, wherein the surge piston spring and the surge piston are configured to initiate movement upon the slave cylinder abutting the slave cylinder stop.

16. The engine of claim 3 further comprising an oil supply passage coupled to the volume and including a check valve.

17. The engine of claim 3 further comprising a hydraulic plunger adjacent the volume, wherein movement of the hydraulic plunger is resisted by the hydraulic fluid flowing adjacent the plunger prior to valve closure.

18. The engine of claim 1, wherein the cam follower pivots relative to the rocker arm.

19. The engine of claim 1, wherein the rocker arm pivots about a fixed axis.

20. The engine of claim 1, wherein the rocker arm is coupled to a valve such that movement of the rocker arm moves the valve to an opened state.

21. The engine of claim 1, wherein the cam follower includes a roller.

22. The engine of claim 1, wherein the rocker arm is coupled between the cam follower and the valve so as to move relative to the valve through an adjustable distance prior to transmitting motion to the valve to pivot the valve.

23. The engine of claim 1 further comprising an unchanging amount of hydraulic fluid between the piston and the slave cylinder during opening and closing of the valve.

24. The engine of claim 1, wherein the valve comprises one of an intake valve and an exhaust valve.

25. An internal combustion engine comprising:

a rocker arm;

a cam follower;

a valve;

means for providing lost motion between the rocker arm and the valve, wherein the means for providing lost motion comprises a slave cylinder;

means for adjusting the lost motion; and an unchanging amount of hydraulic fluid in a volume adjacent the slave cylinder during opening and closing of the valve.

26. The engine of claim 25, wherein the slave cylinder is spring-loaded.

27. The engine of claim 25 further comprising:

an adjustable stop; and damping means between the slave cylinder and the adjustable stop for damping movement of the slave cylinder relative to the adjustable stop.

28. The engine of claim 25 further comprising means for adjusting positioning of the slave cylinder.

29. The engine of claim 25 further comprising damping means for reducing velocity of the rocker arm immediately prior to full valve closure.

30. A method comprising:

rotating a cam against a cam follower to move cam follower relative to a rocker arm to pivot the rocker arm to move a valve; and adjusting an extent of lost motion between the rocker arm and the valve to adjust a distance through which at least one of the cam follower and the rocker arm moves prior to transmitting motion to the valve, wherein the adjusting of the extent of lost motion includes adjusting positioning of a slave cylinder coupled to the rocker arm and adjacent hydraulic fluid coupled between the slave cylinder and the cam follower.

31. The method of claim 30, wherein the adjusting of the extent of lost motion includes adjusting a volume of hydraulic fluid between the cam follower and the rocker arm.

32. The method of claim 30, wherein the adjusting of the position of the slave cylinder comprises selectively rotating an eccentric coupled to the slave cylinder.

33. The method of claim 30, wherein the adjusting of the position of the slave cylinder comprises sliding a ramp coupled to the slave cylinder.

34. The method of claim 30, wherein the adjusting of the extent of lost motion is based upon at least one of throttle position, engine speed or manifold air pressure of an internal combustion engine.

35. The method of claim 30, wherein a larger extent of lost motion is provided during idling conditions or during starting of the engine relative to an extent of lost motion provided at other engine speeds.

36. An internal combustion engine comprising:

a cam shaft;

a valve;

a cam follower coupled between the cam shaft and the valve; and a rocker arm coupled between the cam follower and the valve, wherein at least one of the cam follower and the rocker arm is configured so as to move through an adjustable distance prior to transmitting motion for moving the valve, wherein the cam follower is coupled between the rocker arm and the camshaft so as to move relative to the rocker arm through the adjustable distance prior to transmitting motion from the cam shaft to the rocker arm to pivot the rocker arm.

37. An internal combustion engine comprising:

a cam shaft;

a valve;

a cam follower coupled between the cam shaft and the valve; and a rocker arm coupled between the cam follower and the valve, wherein at least one of the cam follower and the rocker arm is configured so as to move through an adjustable distance prior to transmitting motion for moving the valve, wherein the cam follower is operably coupled to the rocker arm by a hydraulic fluid contained in a volume between the cam follower and the rocker arm.

* * * * *